US005886774A

United States Patent [19]

Nishida et al.

[11] Patent Number: 5,886,774

[45] Date of Patent: Mar. 23, 1999

[54] PHOTOGRAPHIC PROCESSING SYSTEM AND METHOD OF COLLATING ORDER FOR USE WITH THE PROCESSING SYSTEM

[75] Inventors: Shigeki Nishida; Yuji Yamamoto, both of Wakayama, Japan

[73] Assignee: Noritsu Koki Co., Ltd., Wakayama-Ken, Japan

[21] Appl. No.: 806,738

[22] Filed: Feb. 27, 1997

[30] Foreign Application Priority Data

| | | | |
|---|---|---|---|
| Mar. 1, 1996 | [JP] | Japan | 8-043935 |
| Mar. 15, 1996 | [JP] | Japan | 8-058773 |
| Apr. 9, 1996 | [JP] | Japan | 8-086118 |

[51] Int. Cl.[6] ..... G03D 27/52

[52] U.S. Cl. ..... 355/40; 355/41; 355/27; 396/568

[58] Field of Search ..... 355/27–29, 40, 355/41; 396/612, 620, 589, 591

[56] References Cited

U.S. PATENT DOCUMENTS

| | | | |
|---|---|---|---|
| 4,186,837 | 2/1980 | Popiel et al. | 209/565 |
| 4,974,096 | 11/1990 | Wash | 355/40 |
| 5,124,742 | 6/1992 | Yoshikawa | 355/41 |
| 5,159,385 | 10/1992 | Imamura | 355/28 |
| 5,207,332 | 5/1993 | Tanaka | 209/569 |
| 5,227,827 | 7/1993 | Murakami | 396/567 |
| 5,452,050 | 9/1995 | Ishikawa et al. | 355/27 |

FOREIGN PATENT DOCUMENTS

| | | | |
|---|---|---|---|
| 0108987 | 5/1984 | European Pat. Off. | G03D 15/00 |

OTHER PUBLICATIONS

Abstract of EP 108987 A (English).

*Primary Examiner*—D. Rutledge
*Attorney, Agent, or Firm*—Fulbright & Jaworski, LLP

[57] ABSTRACT

A photographic processing system is disclosed. The system includes a bar-code reader for reading processing information of a photographic film, a sorter station for sorting the film in accordance with the processing information read from the film, a photographic processing apparatus for effecting a photographic processing operation in accordance with the processing information and a conveying device for conveying the film sorted at the sorter station to the photographic processing apparatus.

32 Claims, 14 Drawing Sheets

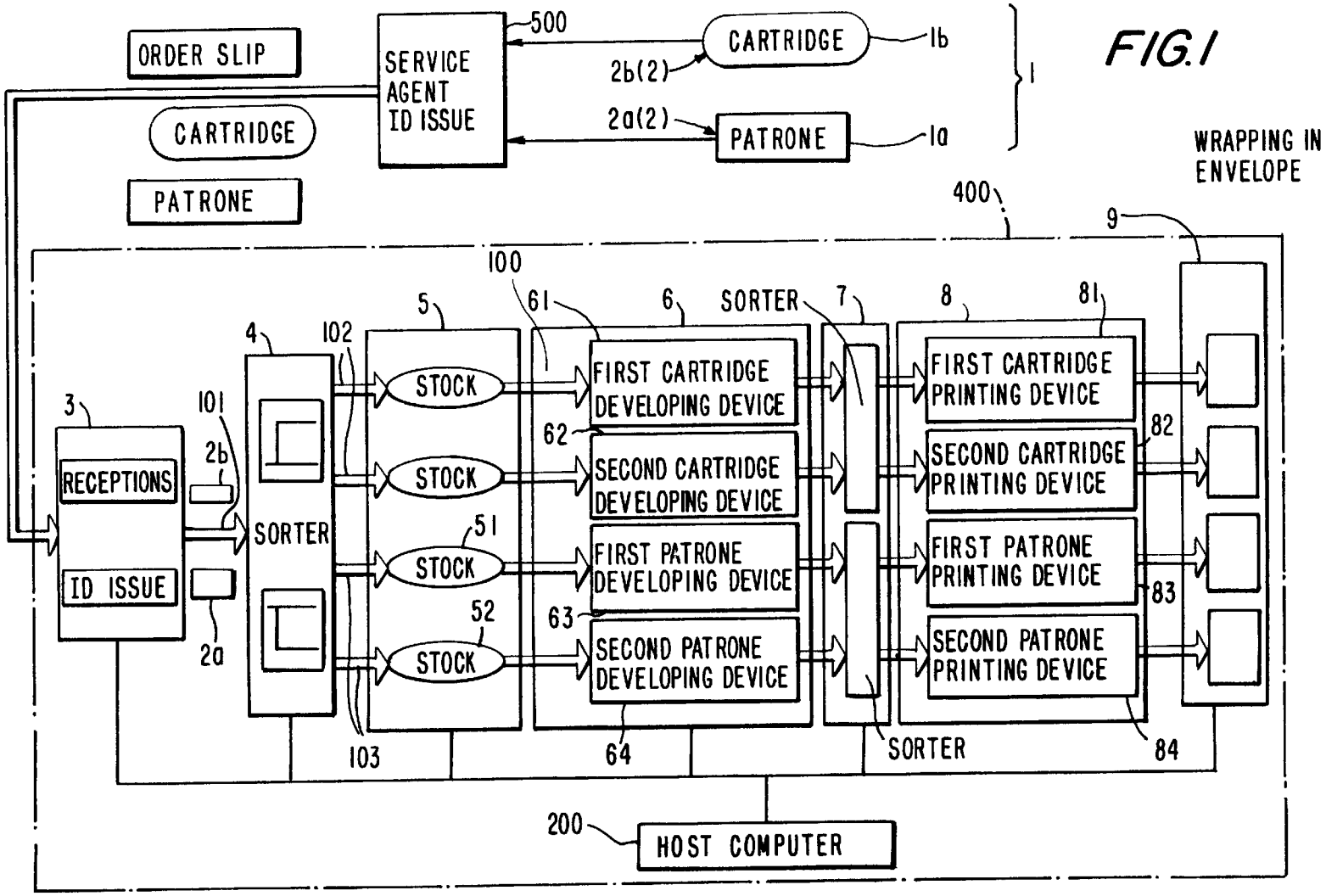
FIG.1
WRAPPING IN ENVELOPE
9
400
1
8
81
82
83
84
FIRST CARTRIDGE PRINTING DEVICE
SECOND CARTRIDGE PRINTING DEVICE
FIRST PATRONE PRINTING DEVICE
SECOND PATRONE PRINTING DEVICE
SORTER
7
SORTER
6
FIRST CARTRIDGE DEVELOPING DEVICE
SECOND CARTRIDGE DEVELOPING DEVICE
FIRST PATRONE DEVELOPING DEVICE
SECOND PATRONE DEVELOPING DEVICE
61
62
63
64
100
5
STOCK
STOCK
STOCK
STOCK
51
52
102
103
4
SORTER
101
2b
2a
3
RECEPTIONS
ID ISSUE
HOST COMPUTER
200
CARTRIDGE
PATRONE
1b
1a
2b(2)
2a(2)
500
SERVICE AGENT ID ISSUE
ORDER SLIP
CARTRIDGE
PATRONE

PHOTOGRAPHIC PROCESSING SYSTEM AND METHOD OF COLLATING ORDER FOR USE WITH THE PROCESSING SYSTEM

BACKGROUND OF THE INVENTION

1. Field of the Invention

The present invention relates to a photographic processing system for effecting a photographic processing operation based on photographic processing information read from a photographic film adapted for image recording. The invention relates also to a method of collating an order for use with the photographic processing system.

2. Description of the Related Art

A photographic processing system of the above-noted type is known from e.g. Japanese laid-open patent gazette Hei. 7-244365. According to this system, development information is recorded in a photographic film in the course of a developing operation thereof. Then, when this film is printed, whether this is a first printing or a second or reprinting, printing exposure of the film is controlled based on the development information recorded in the film so as to obtain a uniform printing effect.

On the other hand, Japanese laid-open patent gazette Hei. 6-95349 proposed another photographic printing system designed for facilitating developing and printing services. In this system, there are used, in combination, a photographic film having a transparent magnetic recording layer and a film wrapping envelope having a magnetic recording layer. Then, when a consumer brings this film to a photographic service shop or agent for its development and/or printing, a shop attendant, by using a customer-order managing machine specially adapted therefor, records, in both the recording layers, information for collation in the form of e.g. an ID code or the like. After the development/printing, by utilizing the magnetically recorded information, an automatic packing device installed adjacent an exit of the photographic processing system effects automatic collating operation of the recorded information so as to pack the film into its corresponding wrapping envelope.

In this manner, by recording service management information such as an ID code in the film and in the film wrapping envelope, the system is intended to simplify the series of photographic processing service from the consumer's order to the shipping of the ordered product from the photographic processing laboratory back to the agent and subsequently to the consumer.

The above-described systems have provided the consumer and the service agent with the advantages of the possibility of obtaining prints of uniform quality from a same photographic film and facilitated yet reliable photographic processing service management without order error. On the other hand, on the processing laboratory side, these systems have created new causes of inefficiency in the developing and printing operations, since the laboratory now has to cope with the processing information uniquely provided to each film to be processed. More specifically, for processing each film, the laboratory has to set the developing and/or printing devices to particular conditions in order to suit a particular film length, size of the printing paper or the like as required of this particular film. Especially, in view of the fact that these developing and printing operations are being effected in a mass-production manner in recent years, it will be a considerable problem if the settings of the developing and printing devices have to be done frequently.

Considering the above-described state of the art, a primary object of the present invention is to provide an improved photographic processing system adapted for such ID code or any other processing information provided in the film and/or its container (e.g. the film and print wrapping envelope) which system does not reduce the efficiency of the developing and printing operations at a photographic processing laboratory.

SUMMARY OF THE INVENTION

For accomplishing the above-noted object, a photographic processing system, according the present invention, comprises:

- means for reading processing information of a photographic film;
- a sorter station for sorting the film in accordance with the processing information read from the film;
- a photographic processing apparatus for effecting a photographic processing operation in accordance with the processing information; and
- a conveying device for conveying the film sorted at the sorter station to the photographic processing apparatus.

With the photographic processing system described above, in the case of a photographic film on which both a developing operation and a printing operation are to be effected at one time according to the consumer's order ('simultaneous-print film' hereinafter), first, the reading means reads the processing information recorded in this undeveloped film and then the sorter station sorts the film according to the information read. At this stage, if plural units of developing devices are provided in the photographic processing apparatus, which devices are set to different developing conditions from each other, the conveying device directly conveys this film to one of the developing devices set to a particular developing condition suited for this film. On the other hand, if only one developing device is available, the system repeats the above reading and sorting steps for a plurality of films so as to sort out a predetermined number of films to be developed in the same condition as the first film. Then, the system effects developing operations on these films at one time in the form of a batch processing, thereby to avoid frequent setting of the developing device. More specifically, in the case of developing operation, the essential factor be be considered in sorting is the film length. This is because the developing device is generally designed so as to develop at one time a plurality of film strips which are spliced to each other at the leading ends thereof. Then, if a plurality of films of different lengths were developed together as one group, this would cause significant degree of deviation in necessary estimation of e.g. consumption or fatigue of the developing liquid.

On the other hand, if the photographic processing apparatus is a printing device(s), i.e. in the case of a printing operation of developed films, the system also effects a similar sorting operation of the film. In this case, in order to minimize the frequency of the troublesome changing operations of the printing paper, it is desirable for a single printing device to be able to receive in succession a plurality of films to be printed in a same printing size, i.e. one type of processing information recorded therein. In this case too, if there are available a plurality of printing devices set to different printing conditions, each single film may be immediately conveyed to a suitable printing device. Yet, in case there is only one printing device available, the efficiency of the printing operations may be significantly improved if a plurality of films to be printed in a same print size are batch-processed.

In the above, the film length or the print size is cited as an example of the processing condition. Needless to say, however, the processing condition may also be a processing speed, an exposure-correction amount, type of printing paper quality or the like. Preferably, the photographic processing system further comprises a host computer capable of storing an ID code and the processing information of the film in correlation with each other, the host computer being connected with the respective components of the system so as to control the respective components in accordance with the ID code and the processing information for processing the film. This feature leads to the possibility of an unmanned operation of the photographic processing laboratory.

According to a further aspect of the present invention, a photographic processing system comprises:

first reading means for reading printing information of a 're-ordered print film' (i.e. a film on which a consumer has ordered its printing or reprinting not simultaneously with its development);

a first sorter station for sorting the re-ordered print film according to the printing information:

a plurality of printing devices each capable of printing the re-ordered print film according to the printing information; and a conveying device for conveying the re-ordered film sorted at the first sorter station to one of the printing devices.

According to the above-described system, first, the first reading means reads printing information of a re-ordered print film, and then the first sorter station sorts the re-ordered print film according to the printing information. More particularly, the sorter station effects sorting between a film to be printed in a full size and a film to be printed in a panoramic size, for instance. Then, each film thus sorted is conveyed to a printing device suited for its printing information. Namely, the plurality of printing devices are set to different printing conditions from each other to cope with different printing information. So that, a same printing device effects printing of films having common printing information. Accordingly, a same printing device is capable of printing both a simultaneous print film and a re-ordered print film.

According to a further embodiment of the present invention, in the photographic printing system having the above-described construction, the system further comprises:

second reading means for reading printing information of a simultaneous-print film;

a second sorter station for sorting the simultaneous-print film according to the printing information;

the conveying device being capable of conveying the re-ordered print film sorted at the first sorter station and the simultaneous print film sorted at the second sorter station together in a mixed state along a common conveying passage to one of the printing devices;

means for distinguishing a position of each film on the conveying passage.

With the above-described system construction, the conveying passage for the simultaneous-print films and the conveying passage for the re-ordered print films are combined into one common conveying passage. Then, through this efficient common use of the conveying passage, the operational efficiency of the entire system may be improved. Further, as the distinguishing means (e.g. a bar code) for distinguishing the position of each film on the conveying passage, it is readily possible to distinguish to which particular printing device the film on the conveying passage should be conveyed.

Preferably, in the above-described system, the system further comprises a host computer capable of causing a re-ordered print film and a simultaneous-print film having common printing information to a same one of the printing devices. With this, each film may be automatically conveyed to a suitable conveying device. Further, the film may be provided with an ID code, and the host computer may be adapted to be capable of storing the ID code and the printing information of the film in correlation with each other. With this feature, an unmanned operation of the entire photographic processing system becomes possible, whereby the maintenance and running costs of the system may be advantageously reduced.

Preferably, the first reading means reads the printing information from an information medium storing therein at least either consumer information or re-order information. On specific example of this information medium is an order slip (or 'slip book' as will be described later) issued at a service agent. Namely, if a shop attendant had to manually read and manage the consumer information and the re-order information recorded in the order slip, he/she would find significant trouble in doing this in case the agent handles a large number of customer i.e. consumer orders, and the number of steps needed for properly managing such information too would be considerable. Then, by providing such information in the form of electrically recorded data and reading them by the reading means, the information managing steps may be advantageously reduced. It is preferred especially that these data be managed by the host computer described above, Preferably, the system further comprises a film magazine for handling the films described above. In the case of the so-called 135 film, if this film is a re-ordered print film, the processing laboratory generally receives, from the service agent, this film in the form of a plurality of film strips cut into the length of 4 or 6 frames that are stored within a film sheet holder. That is, one order amount or length of film consists of a plurality of such film strips. Hence, consideration should be made in order to facilitate handling of such film strips.

Then, for this purpose, the system preferably includes the film magazine capable of storing at least one order amount of re-ordered print film rolled therein. Then, by using this film magazine, the re-ordered print film is conveyed to the printing device.

More preferably, the simultaneous-print film is conveyed to the printing device by using the film magazine described above. Or, the film magazine may be used alternatively for storing films having common printing information to be conveyed to the printing device. As the same film magazine to be handled by the conveying device or printing device is used regardless for the simultaneous print film and the re-ordered print film, the operational efficiency of the entire system may be improved and also the designing of the entire system may be facilitated.

As may be understood from the above, the 'film' as used herein is understood to refer not only to a film not stored in the film magazine but also to a film stored in the magazine.

Further and other objects, features and effects of the invention will become more apparent from the following more detailed description of the embodiments of the invention with reference to the accompanying drawings.

BRIEF DESCRIPTION OF THE DRAWINGS

FIG. 1 is a block diagram showing a general construction of a photographic processing system according to the present invention.

DESCRIPTION OF THE PREFERRED EMBODIMENTS

Figure 2:
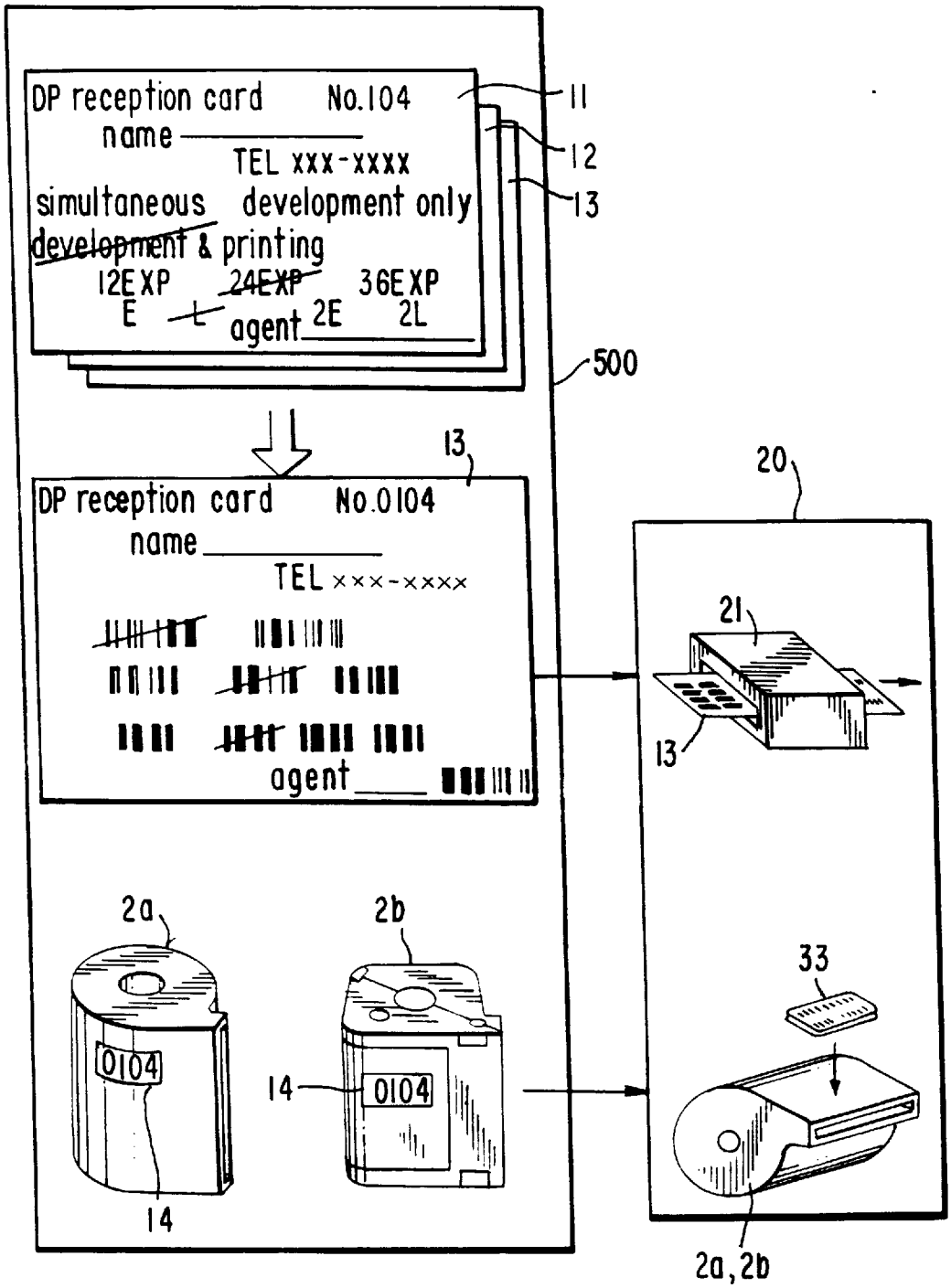
FIG. 2 is a descriptive view illustrating operations effected at a service agent.

A first preferred embodiment of the present invention will be described next.

In this embodiment, a photographic processing system is adapted for handling two kinds of films and film containers corresponding thereto, i.e. a film 1*a* stored in a patrone 2*a* as the well-known film container and a film 1*b* stored in a cartridge 2*b* as a newly standardized film container 2 in accordance with the APS (Advanced Photograph System). In the following disclosure, when appropriate and sufficiently unambiguous, the term: 'patrone 2*a*' or 'cartridge 2*b*' may refer not only to the container per se but also to the film 1*a* or 1*b* contained therein, First, a general construction of a photographic processing system installed usually in a large-scale photographic processing laboratory will be described with reference to FIG. 1.

A receiving station 3 for handling receptions of the patrone 2*a* or cartridge 2*b* and a laboratory slip (to be detailed later) sent from a service agent 500 functions as an input section in this photographic processing system. At this receiving station 3, an ID code provided to the patrone 2*a* or cartridge 2*b* and photographic processing information provided to the laboratory slip are read and these pieces of information are correlated to each other to be transmitted to a host computer 200 from which the information may be freely searched and retrieved.

After completion of the receiving process, the patrone 2*a* or cartridge 2*b* is conveyed to a first sorter station 4, where the patrone 2*a* and the cartridge 2*b* are sorted from each other. Then, the sorted patrone 2*a* or cartridge 2*b* is caused to stay, until its development, at a first stock station 5 installed immediately before a developing station 6. When given a command for initiating development, the patrones 2*a* or cartridges 2*b* staying at the first stock station 6 are conveyed one after another to the developing station 6 to be developed therein. At a second sorter station 7, the developed film 1*a* or 1*b* is sorted according to the printing condition included in the photographic processing information to a suitable conveying line. The developed film 1*a* or 1*b* sorted in the above manner is then exposed at a printing station 8 to have its images printed on printing papers. In this, a film 1 having processing information concerning development alone is caused to bypass the printing station. However, in order to clearly distinguish between a film for development alone and a simultaneous-print film, for the former type of film for development alone, there is produced at least one blank print at the printing station 8. With this, in the subsequent sorting step after printing, it becomes possible to clearly distinguish the above two kinds of films from each other.

The film 1*a*, 1*b* and its prints produced at the printing station 8 are packed together into a wrapping envelope by means of a packing device installed at a shipping station 9 which functions as an output section of this photographic processing system. The conveying operations of the film 1*a*, 1*b*, the patrone 2*a* or cartridge 2*b* and the prints are mostly effected by means of a conveying device 100 which is illustrated schematically only in the form of a plurality of conveying lines. The control operations of the respective stations and the conveying device of the photographic processing system as well as monitoring operations of the films 1*a*, 1*b* being printed are effected by the host computer 200.

Next, the flow of the photographic processing of the exposed films using the photographic processing system having the above-described construction will be described next in greater details.

When a consumer brings a film container 2 containing an exposed film 1, i.e. patrone 2*a* or a catridge 2*b* to a service agent 500 of a photographic processing laboratory 400 and orders simultaneous development and printing of the films the agent 500 keeps this film container 2 with the film therein and issues a three-sheet order slip book as illustrated in FIG. 2. This slip book consists of a customer's duplicate slip 11 to be handed to the consumer, an agent's confirmation slip 12 to be kept at the agent 500 and a laboratory slip 13 to be sent to the processing laboratory 400 together with the film 1*a*, 1*b*. The conventionally well-known film 1*a* is stored in the patrone 2*a*. And, in the case of this type of film, after its first printing, the film is cut into a plurality or film strips each including a predetermined number of frames and these strips together with their prints are placed into an envelope to be returned to the consumer. On the other hand, in the case of the so-called cartridge film according to the recently standardized APS system, after the development and printing, the cartridge 2*b* containing the developed film 1*b* is returned to the consumer.

The above-described order slip book includes such photographic processing information as 'presence/absence of order for simultaneous development and printing', 'film length', 'print size' and so on recorded in the form of a plurality of bar codes. The book further includes entries in which such customer or customer information as the name, address, telephone number of the customer are to be entered. Further, at the time of issue of this order slip book, in order to allow future collation between this order slip book and the patrone 2*a* or cartridge 2*b*, a number label 14 bearing a numeral corresponding to a serial number of the order slip book is affixed to the patrone 2*a* or cartridge 2*b* as an ID code between the service agent 500 and the processing laboratory 400.

Figure 3:
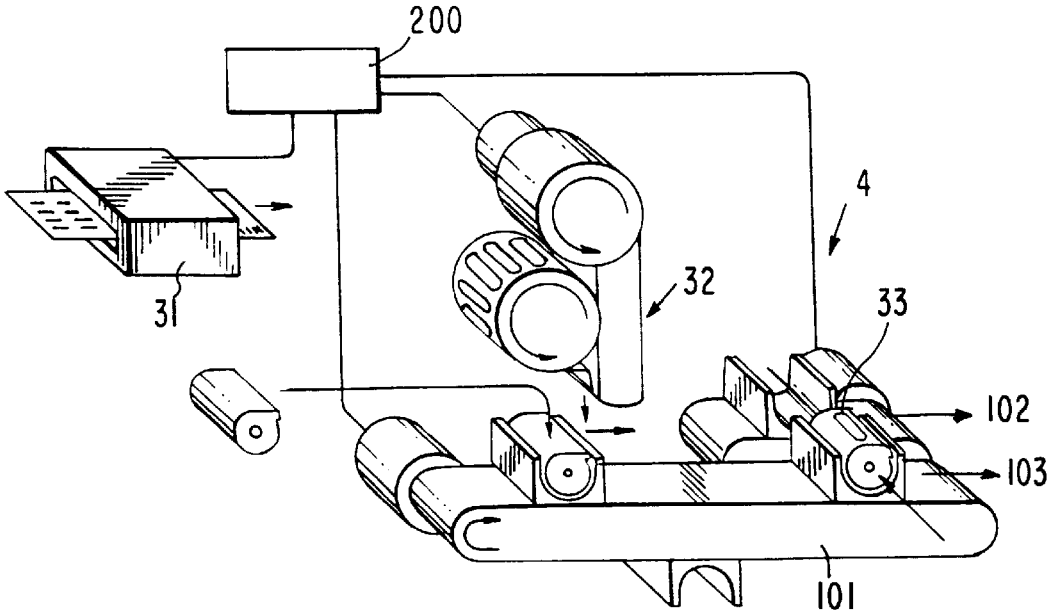
FIG. 3 is a schematic view showing a receiving station and a part of a first sorter station, FIGS. 4(*a*) through 4(*c*) is a schematic view showing a double-light shielding construction of a film cartridge.

The laboratory slip 13 of the order slip book and the film container 2, i.e. the patrone 2*a* or cartridge 2*b*, are sent to the processing laboratory, where the reception operations are effected at the receiving section 3. in these reception operations, as illustrated in FIG. 3, the above-described photographic processing information recorded in the laboratory slip 13 is read by a bar-code reader 31 and transmitted to the host computer 200 of the photographic processing system installed in the processing laboratory. At the same time, for allowing collation between the film 1 and its film container 2 within this processing system, a bar-code label 33 bearing an ID code is issued by a bar-code label issuing machine 32 and affixed to the corresponding film container 2. The ID code of this bar-code label is also transmitted to the host computer 300, in which the code is correlated with the corresponding photographic processing information described above, such that the host computer 200 may obtain the photographic processing information given to each film 1 introduced into this photographic processing system.

The film container 2 having the ID bar-code label 33 affixed thereto is introduced to a first processing-conveying line 101 of the processing system. In this first processing line 101, the first sorter station 4 is provided which sorts the film containers 2 into either a cartridge 2*b* or patrone 2*a* to be conveyed to a cartridge processing line 102 or patrone processing line 103, respectively. In each processing line, the cartridge 2*b* or patrone 2*a* is further sorted in accordance with the development condition included in the photographic processing information provided uniquely thereto. For, in the system of this embodiment, the cartridge processing line 102 includes first and second cartridge developing devices 61, 62 which are set to different developing conditions from each other, and the patrone processing line 103 includes first and second developing devices 63, 64 which are set to different developing conditions from each other. More particularly, in the sorting step of the film container 2 at this first sorter station 4, the bar-code label 33 affixed to the film container 2 conveyed in the line is read. So that, based on the type of the container confirmed by the ID code, the development processing conditions such as the film length or the like, this film container 2 is selectively conveyed to one developing line including a developing device suitable for the particular development processing conditions.

For each processing station 102 or 103, there is provided the stock station 5 immediately before the developing station 6. At this stock station 5, the film container 2 is caused to stay until the time of its development comes. In the stocking process at this stock station 5, the cartridge 2*b* is stocked in a cartridge case capable of storing a plurality of cartridges 2*b* therein. Also, the patrone 2*a* is stocked in a patrone case capable of storing a plurality of patrones 2*a* therein. The cartridge case may be attached to a film charging portion of a first cartridge developing device 61 or of a second cartridge developing device 62. Similarly, the patrone case may be attached to a film charging portion of a first patrone developing device 63 or of a second patrone developing device 64.

When all the cartridges 2*b* or patrones 2*a* are drawn out of the cartridge case or patrone case (these cases may be Generically referred to as a 'case' hereinafter), the emptied case is detached from the film charging portion and a new case is attached thereto. This case replacement is done automatically. Further, the emptied case is returned to e.g. the stock station 5. In this manner, it is possible to avoid unnecessary increase in the number of cases needed. The returning operation of the case is effected manually by the operator or automatically by a belt conveyer.

Further, at the stock station 6, the stock amount of the films 1 is monitored by a monitor device. This is done for preventing a certain developing device from being charged with too many films 1. As one example of the monitor device, there may be provided a monitor video camera installed at the stock station 5 and a monitoring unit connected with the camera and controlled by the host computer 200. With these, the operational efficiency of the entire system may be improved.

The developing process effected by the first or second cartridge developing device 61, 62 is well-known, and therefore will not be detailed herein. To describe the process just briefly, a lid of the cartridge 2*b* drawn out of the cartridge case is opened and the film 1*b* is drawn therethrough to be sent to the cartridge developing device 61 or 62. In this, two film rolls 1*b* drawn from two cartridges 2*b* are connected at their leading ends to a common leader. And, with this leader at the leading end, the spliced films 1*b* are conveyed through processing tanks installed within the cartridge developing device 61 or 62, whereby the films are developed. At the last stage of this developing process, the developed films 1*b* are disconnected from the leader and then stored into the same corresponding respective cartridges 2*b* as before. Incidentally, for collation between the cartridge 2*b* and the film 1*b*, the ID code attached to the cartridge 2*b* and the ID data recorded in a magnetic recording band provided in the film according to the APS standard are utilized. Alternatively, the developed film may be stored in a film magazine to be described later, rather than in the cartridge 2*b*.

The cartridge 2*b* into which the film 1*b* has been taken up again is conveyed to the second sorter station 7. At this station 7, as the host computer 200 collates between the ID code of the bar-code label 33 affixed to the cartridge 2*b* and the corresponding photographic processing information stored in this computer 200, the cartridge 2*b* is sorted into either one of two groups in accordance with the condition of printing, which is the next processing step. Namely, cartridges 2*b* having common printing conditions are stored in a same cartridge case. So that, the cartridges which are grouped according to the printing conditions are conveyed to the corresponding cartridge printing device 81 or 82.

As is the case with the cartridge developing device 61, 62, the cartridge case may be designed to be attachable also to a film charging portion of the cartridge printing device 81 or 82. Further, the replacing operation and returning operation of the cartridge may be effected in the same manner as described above. The emptied cartridge case is returned from the cartridge printing device 81 or 82 to the cartridge developing device 61 or 62 by means of the belt conveyer.

The developing process by the first and second patrone developing devices 63, 64 is similar to that by the cartridge developing devices. The films 1*a* drawn out of the patrones 2*a* are charged one after another to the patrone developing device. And, in this, two film rolls 1*a* drawn out of two patrones 2*a* are connected to a common leader, and with this common leader at their ends, the films thus spliced are conveyed through the processing tanks of the patrone developing device, whereby the films are developed. In this case, however, unlike the case of the cartridge, the patrone emptied of its film is not to be re-used generally. Then, there is used, instead, the film magazine 300 capable of storing a plurality of films therein. And, a plurality of film magazines 300 are provided. The second sorter station 7 functions so that the films 1*a* having same or common condition of printing which is the next photographic processing step are stored into a same film magazine 300.

Figure 4A:
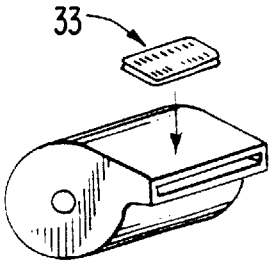
Figure 4B:
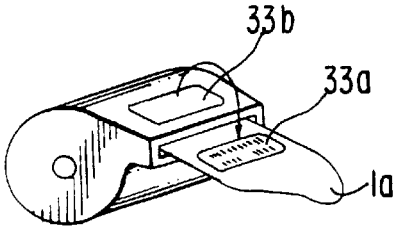
Figure 4C:
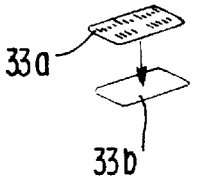

Further, unlike the case of the cartridge 2*b*, the film 1*a* drawn out of the patrone 1*a* does not have, in itself, any special region or means for recording the ID code or the like. Therefore, when the film 1*a* is drawn out of the patrone 2*a*, it is necessary to affix the bar-code label 33 indicating the ID code to the leading end of this film 1*a*. For this purpose, as shown in FIG. 4(*a*) through (*c*), the bar-code label 33 has a double-layered construction including two label sheets, i.e. an upper label sheet 33*a* and a base label sheet 33*b*, bearing the same bar code and placed one on the other. Then, when the film 1*a* is drawn out of the patrone 2*a*, the upper label sheet 33*a* is removed from the base label sheet 33*b*, and the removed upper label sheet 33*a* is then affixed to the leading end of the film 1*b*. With this, when the patrone 2*a* as the film container 2 is disposed of at the initial stage of the developing process, it is still possible thereafter to collate this film 1*a* and the corresponding photographic processing information stored at the host computer 200. Thus, the film 1*a* developed by the first patrone developing device 63 or second developing device 64 is sorted according to the printing condition such as the printing paper size included in the photographic processing information, so that the film is conveyed to the film magazine 300 for storing a plurality of films having the same printing condition as this film.

Figure 5:
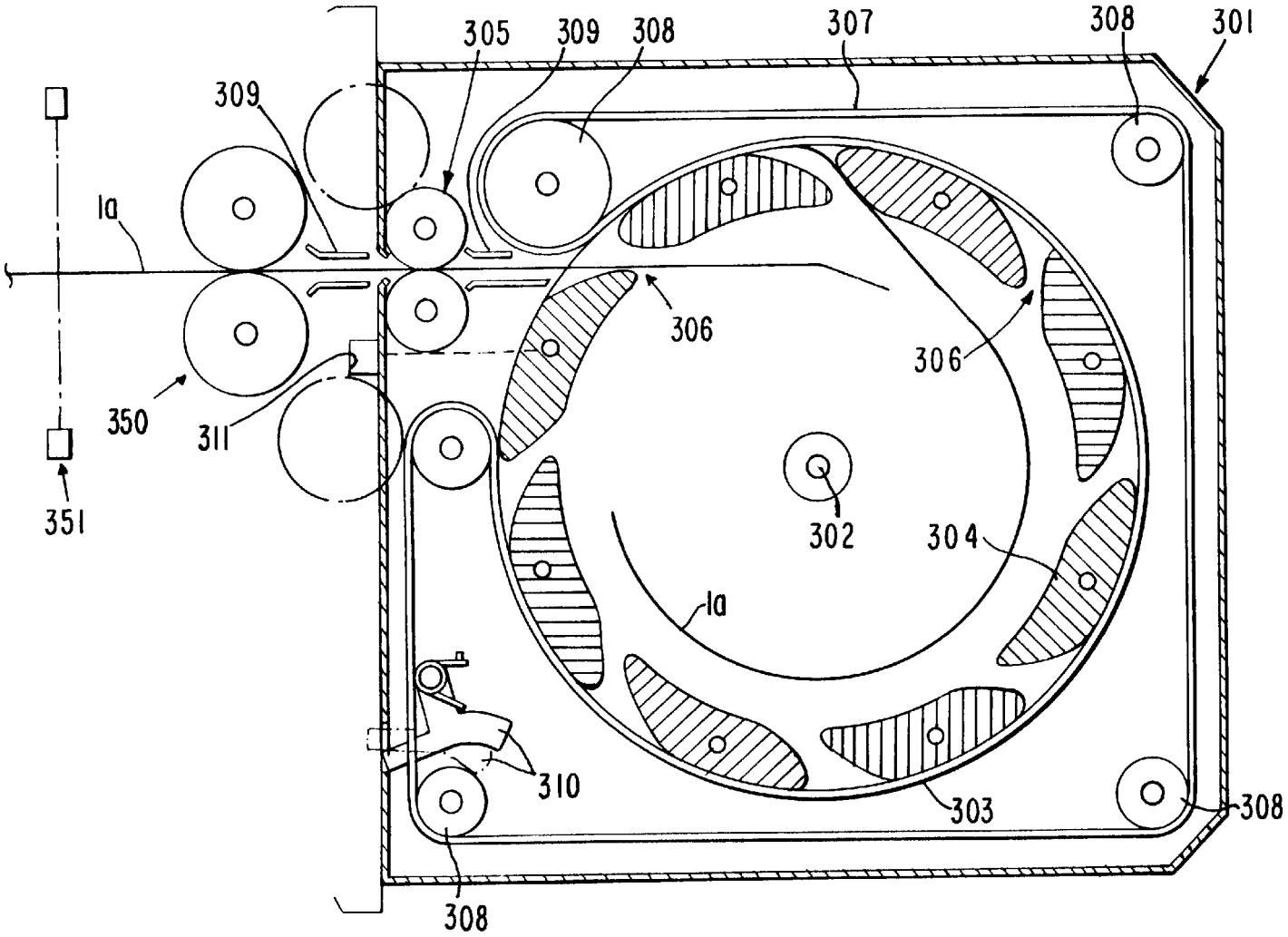
FIG. 5 is a vertical section showing a construction of a film magazine, FIGS. 6(*a*) through 6(*f*) are views illustrating step-wise a process of inserting a film into the film magazine, FIGS. 7(*a*) through (*f*) are views illustrating step-wise a process of inserting a film into the film magazine, FIGS. 8(*a*) through (*d*) are views illustrating stepwise a process of drawing a film out of the film magazine.

Next, the film magazine 300 will be described in greater details,

FIG. 5 shows the general overall construction of this film magazine 300. The film magazine 300 essentially consists of a case 301 forming the general outer appearance of the magazine, a drum 303 rotatable about a rotation axis 302 located at the center of the drum, and a roller mechanism 305 for transporting the film 1*a* in and out of the drum 300. An outer peripheral wall portion 304 of the drum 303 defines total 8 (eight) slits 306 disposed equi-distantly from each other and extending axially of the drum. The side walls of the drum 303 are eliminated from the figure for better understanding of the figure. Through each one of these slits 306, the film 1*a* is introduced to the inside, i.e. the inner storage space, of the drum 303 and discharged therefrom when demanded.

Further, for retaining the trailing ends of the films 1*a* introduced into the drum 303, there is disposed an endless belt 307 along the outer peripheral wall 304 of the drum 303. This endless belt 307 is placed in contact with major portion of the outer peripheral wall 304 of the drum 303, thereby to bind and retain the films 1*a* between this belt 307 and the outer peripheral wall 304. Incidentally, this endless belt 307 includes a plurality of rollers 308, one of which is adapted to receive the driving power from the processing station when the film magazine 300 is attached to the system.

Further, as described hereinbefore, the endless belt 307 is placed in contact with not the entire outer peripheral wall 304 of the drum 303. Rather, the belt 307 is locally detached from the outer peripheral wall 307 at an entrance/exit for the film 1*a* to the slits 306. This non-contacting portion of the belt 307 relative to the outer peripheral wall 304 provides an entrance/exit for the film 1*a* to the inside of the drum 303. Also, at this portion, the belt retention of the film end is released, so that this portion provides also an exit opening for the film 1*a* from the inside of the drum 303. As may be apparent from FIG. 5, an access passage for the film 1*a* to and from the drum 303 is formed by guide plates 309.

The film magazine 300 further includes a rotation restricting arm 310 for preventing inadvertent rotation of the drum 303 during transport of the film magazine 300, and an angular position detecting means 311 for detecting an angular position of the drum 303. As this angular position detecting means 311, any of various known types of positions sensor systems may be employed. For instance, there may be provided, in combination, a magnetic member attached to the outer peripheral wall 304 in the vicinity of the slit 306 and a magnetic sensor disposed in opposition to the magnetic member.

The power necessary for conveying the films 1*a* in and out of the film magazine 300 and for rotatably driving the drum 303 is available from the respective processing station to which the film magazine 300 is attached, For instance, in FIG. 5, numeral 350 denotes conveyer rollers provided in the station for conveying the film 1*a* to and from the magazine 300. The roller mechanism 350 becomes operatively connected with such unillustrated power transmitting device as an output gear or pulley of the processing station when the magazine 300 is attached to this station so as to obtain the necessary power therefrom.

Next, with reference to FIGS. 6(*a*)–6(*f*) and 7(*a*)–7(*f*), the process for feeding the film 1*a* into the film magazine 300 will be described.

In the following description relating to the feeding order, the terms: 'leading end of the film' and 'trailing end of the film' are used for the sake of convenience. Here, it is understood that the leading end of the film refers to the portion of the film which is first discharged from the station i.e. the portion of the film 1*a* which is to be first introduced into the film magazine 300 and also that the trailing end of the film refers to the opposite end of the film which is to be last fed from the processing station.

Figure 6A:
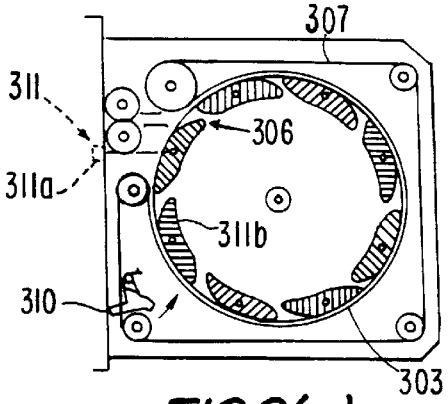
Figure 6B:
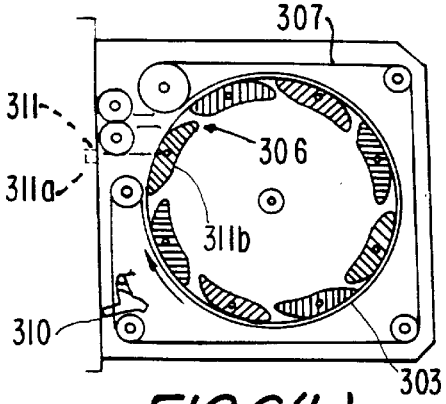
Figure 6C:
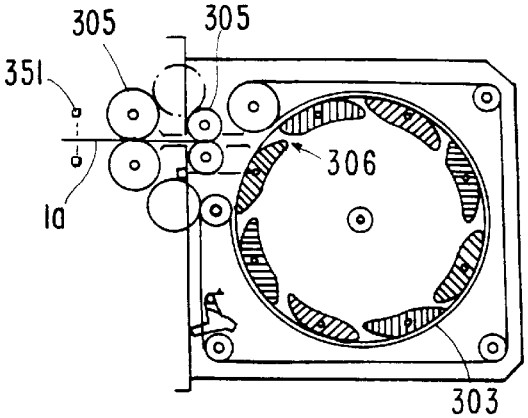

First, the film magazine 300 is attached to the predetermined attaching position of the station (the condition illustrated in FIG. 6*a*). With this attachment, the rotation restricting arm 310 of the film magazine 300 is pivoted to release the restriction of rotation of the drum 303. And, the angular position detecting means 311 detects whether the angular position of the drum 303*s* is presently located at the position allowing insertion of the film 1*a* or not. Then, based on this detection, if the drum 303 is not located at the predetermined position allowing film insertion, the drum 303 is driven to rotate clockwise in the same figure. When the magnetic sensor 311*a* detects the position of a detection target 311*b*, i.e. the magnetic member constituting the angular position detecting means 311 provided to the output peripheral wall 303 which is divided into a plurality of segments by the slits 306 of the drum 303, the rotation of the drum 303 is stopped (the condition illustrated in FIG. 6*b*).

Figure 6D:
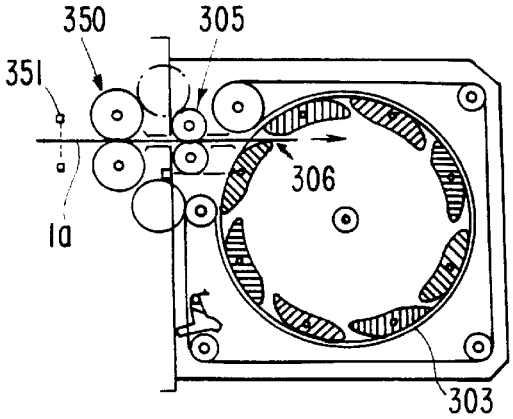
Figure 6E:
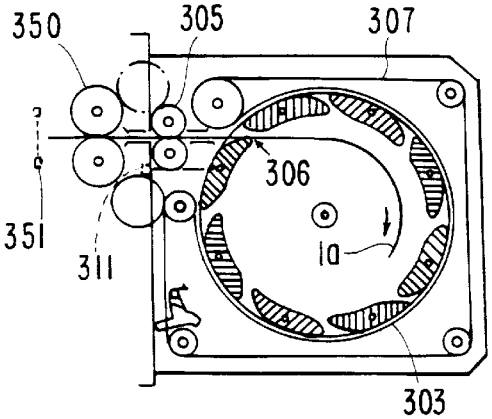

By activating the conveyer rollers 350 and the roller mechanism 305, a conveying operation of the film 1*a* is started (the condition illustrated in FIG. 6*c*), and the leading end of the film 1*a* is introduced into the slit 306 of the drum 303 (the condition illustrated in FIG. 6*d*). From the above condition, the conveying operation of the film 1*a* is continued, until a film sensor 351 is rendered into a non-detecting condition and then a predetermined time period has lapsed, as illustrated in FIG. 6*e*. Namely, at the moment of detecting absence of the trailing end of the film, there still remains a significant distance between the trailing end of the film 1*a* and the slit 306 of the drum 303, thus it is still difficult for the retaining mechanism to retain the film. For this reason, the drum continues to rotate to take up the remaining length of the film therein, and when the length has eventually become suitable for the retention by the film retaining mechanism, the activation of the conveyer roller 350 and the roller mechanism is stopped.

Figure 6F:
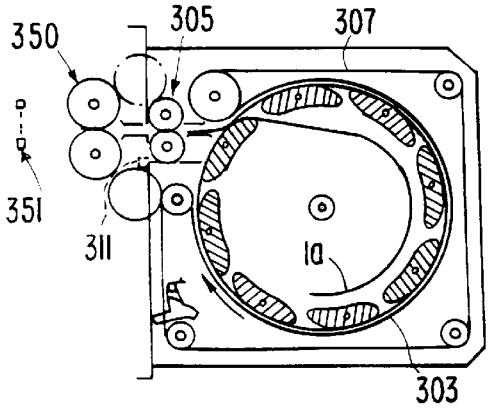

As illustrated in FIG. 6*f*, after the conveyer roller 350 and the roller mechanism 305 are stopped, the drum 303 is rotated. And, this rotation of the drum 303 is stopped when the angular position detecting means 311 detects the predetermined position of the drum 303 allowing film insertion. At this stop position, the endless belt 307 retains the film 1*a* and the drum 303 is ready for receiving a next film 1*a*.

Figure 7A:
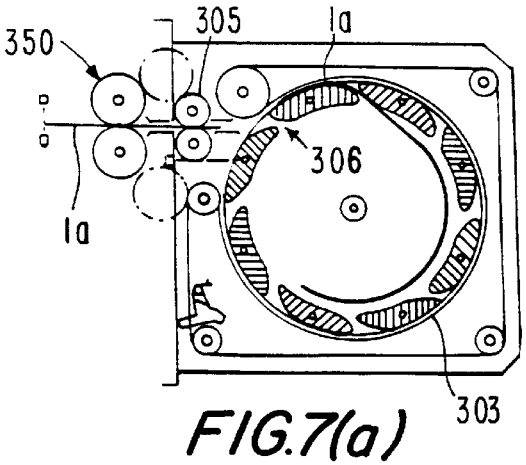
Figure 7B:
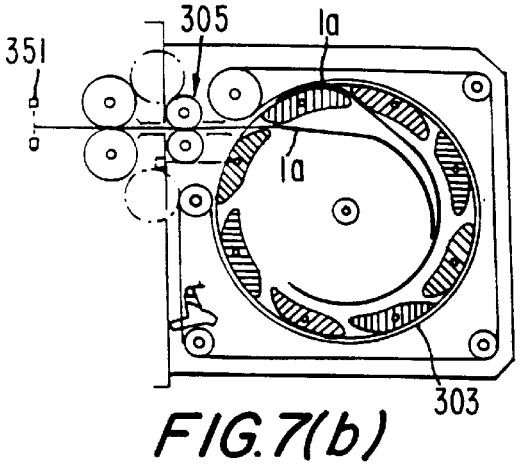

Thereafter, the conveyer roller 350 and the roller mechanism 305 are activated again to convey the next film 1*a* (the condition illustrated in FIG. 7*a*). Then, as illustrated in FIG. 7*b*, the film 1*a* is conveyed into the drum and the trailing end of this film 1*a* is conveyed across the position of the film sensor 351 (the condition of FIG. 7*h*). Then, as described hereinbefore, after the lapse of the predetermined time period, the conveying devices are stopped. Thereafter, the drum 303 is again rotated clockwise. This rotation of the drum 303 is continued until the angular position detecting means 311 detects the predetermined position of the drum allowing film insertion (the condition of FIG. 7*c*).

Figure 7C:
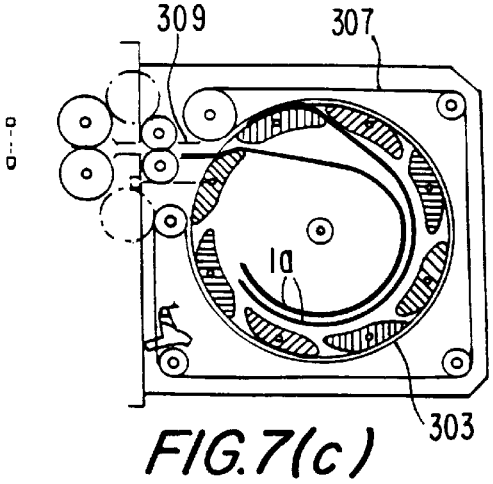
Figure 7D:
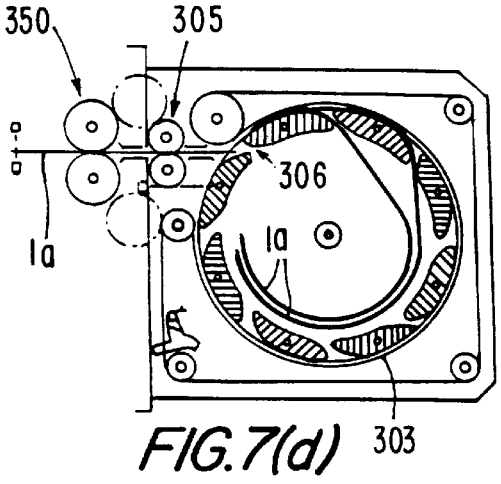
Figure 7E:
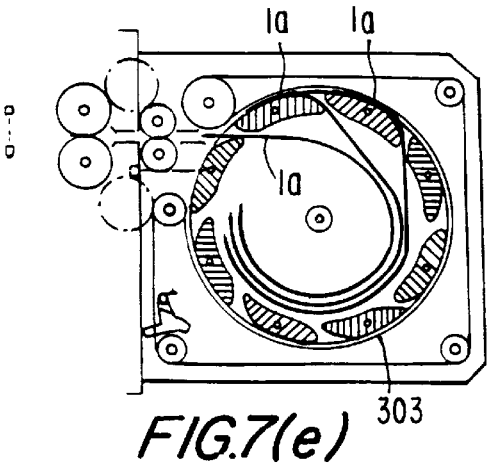
Figure 7F:
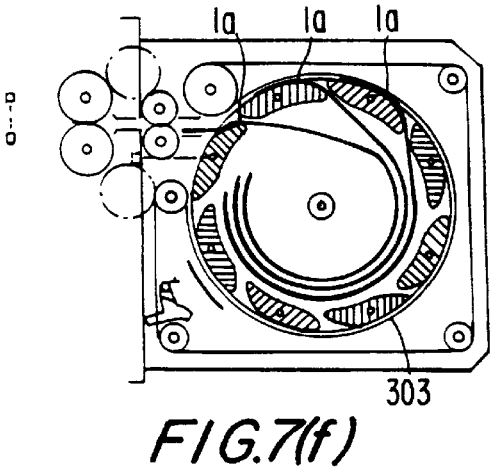

Upon detection of rotation of the drum 303 to the position allowing film insertion, the rotation of the drum 303 is stopped, and the magainze is now ready for receiving the next film 1*a*. Thereafter, as illustrated in FIGS. 7*d*, 7*e*, 7*c*, the steps for inserting this next film 1*a* into the drum 303 are repeated in the same manners as described above.

By the above-described method, films 1*a* having same printing condition are stored in the same film magazine 300 and this magazine 300 is conveyed to the printing station 8.

Next, the reverse process for discharging the films 1*a* by the first-in-first-out method will be described.

Figure 8A:
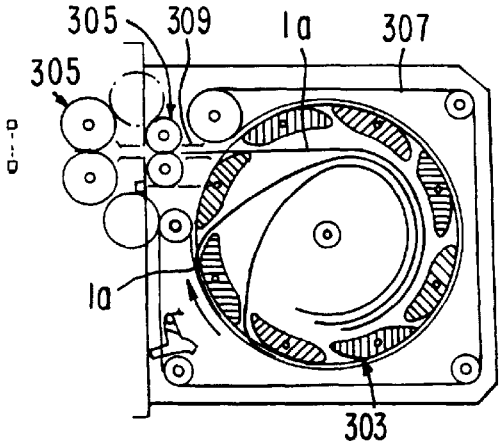

In FIG. 8*a*, for better visual understanding, only three of the total eight films 1*a* stored in the film magazine 300 are shown.

Figure 8B:
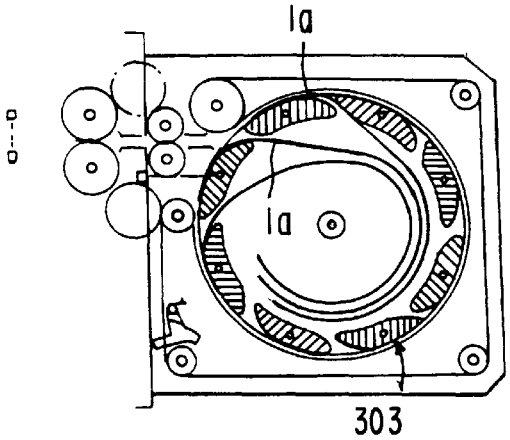
Figure 8C:
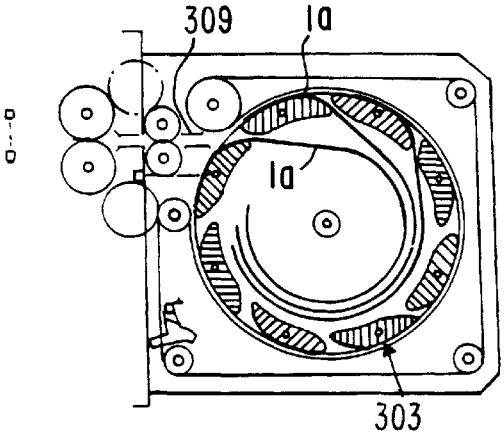
Figure 8D:
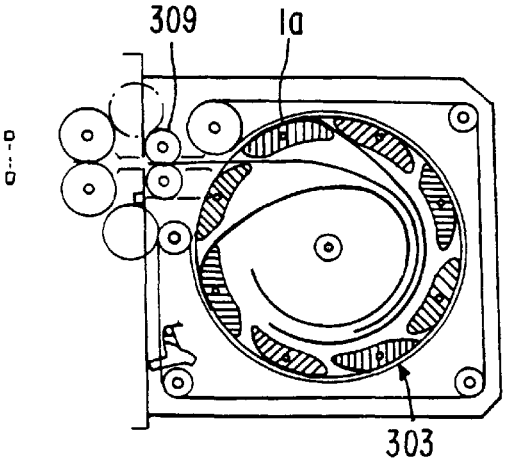

In FIG. 8*a*, it is assumed that the film 1*a* located in the middle of the three f ilms is the one inserted first. For discharging this film 1*a*, first, the drum 303 is rotated clockwise by an amount corresponding to two angular pitches of the slits 306. FIG. 8*b* shows a condition when the drum 303 has been rotated from the condition of FIG. 8*a* by one pitch amount of the slits 306. In this condition of FIG. 8*b*, the trailing end of the target film 1*a* is not yet located between the guide plates 309. Thus, the drum 303 is rotated further to a condition of FIG. 8*c*. However, in this condition, the trailing end of the film 1*a* is located away from the roller mechanism 305, so that the drum 303 is then rotated counter-clockwise to a condition of FIG. 8*d*. This angular displacement of the drum corresponds to one pitch of the slits 306. In this manner, the trailing end of the film 1*a* is caused to pass between the guide plates 309 to reach the roller mechanism 305 eventually. Accordingly, in this condition. by driving the conveyer rollers 350 and the roller mechanism 305, the film 1*a* may be discharged from the film magazine 300. Then, when the leading end of the film 1*a* passes the film sensor 351, the system becomes ready for discharging a next film 1*a*. In a similar manner, the pluralitya of films 1*a* may be discharged one after another in the same order as charging order thereof. Needless to say, the discharging operation may be effected also by a first-in-last-out method. In addition, by storing in memory the position of the film 1*a* by utilizing the detection signal of the angular position detecting means 311, any desired film 1*a* may be discharged in a random order from the magazine 300.

Referring back to the photographic processing system, though not shown in FIG. 1, the conveying line between the second sorter station 7 and the printing station 8 is an endless conveyer line capable also of functioning as stock means for the cartridge case or film magazine 300. Instead of this, a separate stock station may be provided. Namely, the cartridge case or the film magazine 300 is caused to stay on this endlessly moving conveyer line until the printing device to which the cartridge case or the film magazine has been assigned becomes ready for processing the films stored therein. Further, for monitoring the stock condition of the films 1, a monitor device using a video camera, similar to the one described in connection with the stock station 5, is provided.

The printing station 8 includes the first and second cartridge printing devices 81, 82 for printing images of the film 1*b* stored in the cartridge 2*b* on to printing papers. These two printing devices 81, 82 are set to different printing conditions, e.g. different print size conditions from each other, so that each cartridge printing device 81 or 82 selectively receives cartridges 2*b* storing films 1*b* suited to the particular common printing condition thereof. From the received cartridge 2*b*, the film 1*b* is again withdrawn and its ID code is read, thereby to obtain its photographic processing information, i.e. printing information, of this film 1*b* such as the number of prints. Thus, it is also possible to provide the cartridge printing device 81, 82 with an instruction concerning the number of prints, for example. After completion of the printing operation, the film 1*b* is again stored into the cartridge 2*b* and sent to the shipping station 9 together with the printed printing papers, i.e. its prints.

The printing station 8 also includes the first and second patrone printing devices 83, 84 for printing images of the film 1*a* drawn out of the film magazine 300 on to printing papers. These two patrone printing devices 83, 84 too are set to different printing conditions, e.g. different print size conditions from each other, so that each Patrone printing device 83 or 84 selectively receives the film magazine 300 storing films 1*a* suited to the particular printing condition thereof. From the received film magazine 300, the films 1*a* are drawn one after another and the ID code of each film is read, thereby to obtain its photographic processing information of this film 1*a* such as the number of prints. Thus, it is also possible to provide the patrone printing device 83, 84 with an instruction concerning the number of prints, for example.

The emptied film magazine 300 from which the films 1*a* have been all withdrawn is detached from the film charging portion inside the patrone printing device 83 or 84, and then a new film magazine 300 is attached to the charging portion. This replacing operation of the film magazines 300 is effected automatically. Also, the emptied film magazine 300 is returned to its original processing position, namely, to the patrone developing device 63 or 64. With this, it is possible to avoid unnecessary increase of the number of needed film magazines 300. The above returning operation is effected manually by an operator or automatically by using a belt conveyer.

After completion of the printing operation, the film 1*a* is cut into a plurality of film strips, each strip including a predetermined number of frames, e.g. six frames, and these film strips are sent to the shipping station 9 together with their prints produced at the printing station 8.

At the shipping station 9, the film 1*a* or the cartridge 2*b* together with its prints is put into the envelope assigned for each customer and sent back to the service agent 500.

Though not described in details in the above embodiment, specific sample constructions of the first sorter station 4, the first stock station 5 and the conveying device 100 interconnecting these stations 4, will now be described.

Figure 9:
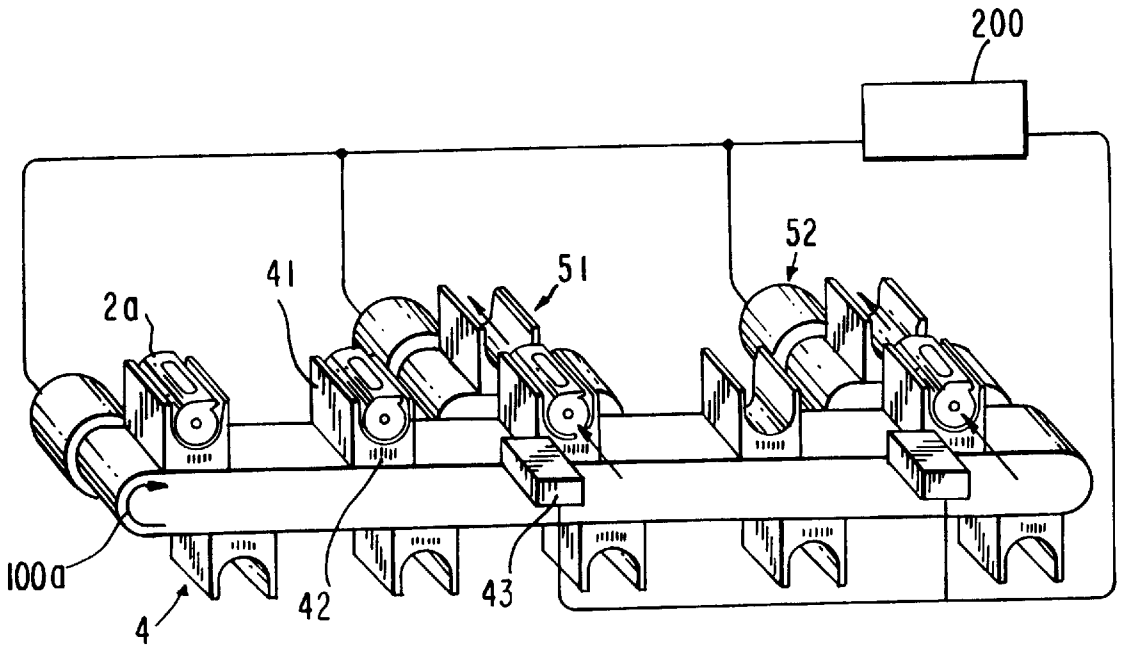
FIG. 9 is a schematic view illustrating a sorting process of film patrones.

FIG. 9 illustrates a condition when the patrones 2*a* sorted at the first stage in the first sorter station 4 are sorted between a first patrone stock device 51 and a second patrone stock device 52 provided in the first stock station 5. A belt conveyer 100*a* for conveying the sorted patrones 2*a* mounts thereon a plurality of pocket members 41 each capable of accommodating one patrone 2*a* therein. The belt conveyer 100*a* is provided as an endless loop. The opposed side ends and the upper end of the pocket member 41 are opened for allowing insertion of the patrone 2*a* from either side or upper side. Further, on a side wall of each pocket member 41, there is attached a bar code 42 indicating an ID code for identifying each pocket member 41. As the drive of the belt conveyer 100*a* is controlled by the host computer 200, the host computer 200 stores information concerning whether a certain patrone 2*a* having s certain ID code is stored in a pocket member 41 having a certain ID code or not.

The belt conveyer 100*a* is connected with the first patrone stock device 51 and the second patrone stock device 52. In operation, a bar code 42 of a pocket member 41 having reached this connecting region is read by a bar-code reader 43 and its information is inputted to the host computer 200. Then, the host computer 200 determines whether to dismount the patrone 2*a* accommodated in this pocket member 41 at this connecting region or not. If the dismounting is necessary, a feeder which is illustrated only schematically by an arrow in the figure is used for shifting the patrone 2*a* into a similar pocket member provided to the first patrone stock device 51 adjacent thereto.

Incidentally, the above-described construction is just a sample construction of the system comprising the combination of the conveying device and the sorter device. It is understood that the present invention is not limited to this particular construction.

In the description of the foregoing embodiment, the re-ordered print film was not referred to. Yet, in case a simultaneous-print film and a re-ordered print film are to be processed together, there also occurs the problem to be attended to by the present invention. This is because the operational efficiency of the system will deteriorate if the simultaneous-print film and the re-ordered print film are processed by entirely independent processing lines.

Specifically, provided processing lines are provided entirely independently of each other, if the processing amount of the simultaneous-print films exceeds that of the re-ordered films, the availability factor of the printing device (s) assigned for re-ordered print films will be necessarily reduced.

Here, it is understood that the 're-order' means a consumer's order for reprinting of a developed film which was previously developed and returned once to the consumer. For such re-ordered print film, the same processing operation is effected except for the developing operation.

Next, a system capable of copying with such re-ordered print films, as a second preferred embodiment of the invention, will be described in details.

Figure 10:
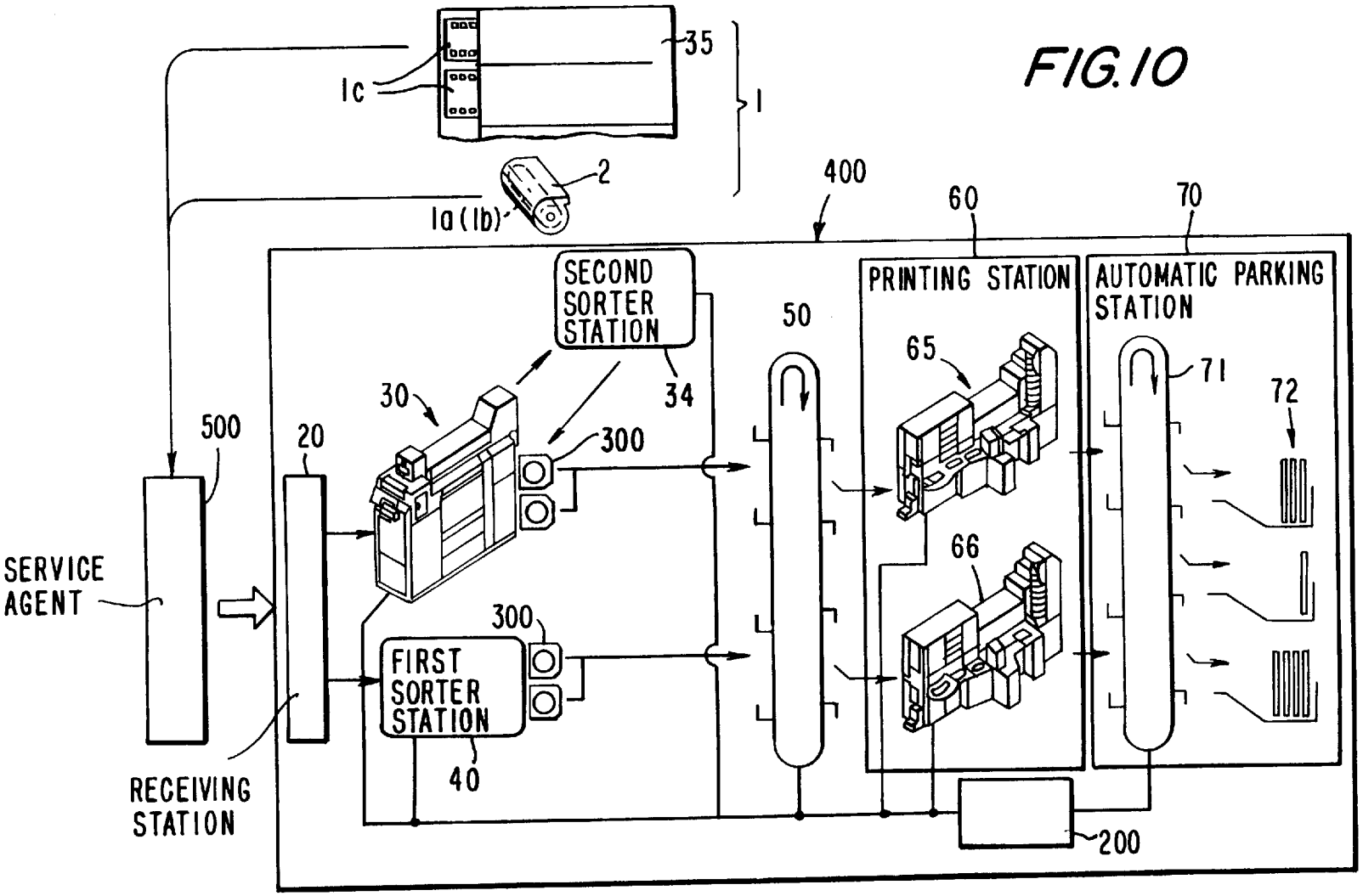
FIG. 10 is a block diagram showing a general construction of a photographic processing system according to a further embodiment of the present invention.

FIG. 10 graphically illustrates a flow in which a film is supplied via the service agent 500 to the processing laboratory where a photographic processing system 400 is installed. In the following description, the photographic processing system and the processing laboratory will be considered as equivalents and both denoted with the common reference numeral 400.

The service agent 500 receives a consumer's order for either simultaneous development and printing of an undeveloped film 1*a* or reprinting (or printing) of a developed film 1*b*. As described hereinbefore, the developed film 1*b* is provided usually in the form of a plurality of film strips 1*c* each including a predetermined number of frames such as six frames or a single film roll stored in the cartridge 2*b*.

Incidentally, in this second embodiment too, the system is to handle two type of films 1 and film containers 2. When approripate and sufficiently umambiguous, the terms, patrone 2*a* and cartridge 2*b* may refer to not only the patrone or cartridge, i.e. the container 2, per se but also the film 1 contained therein.

Figure 11:
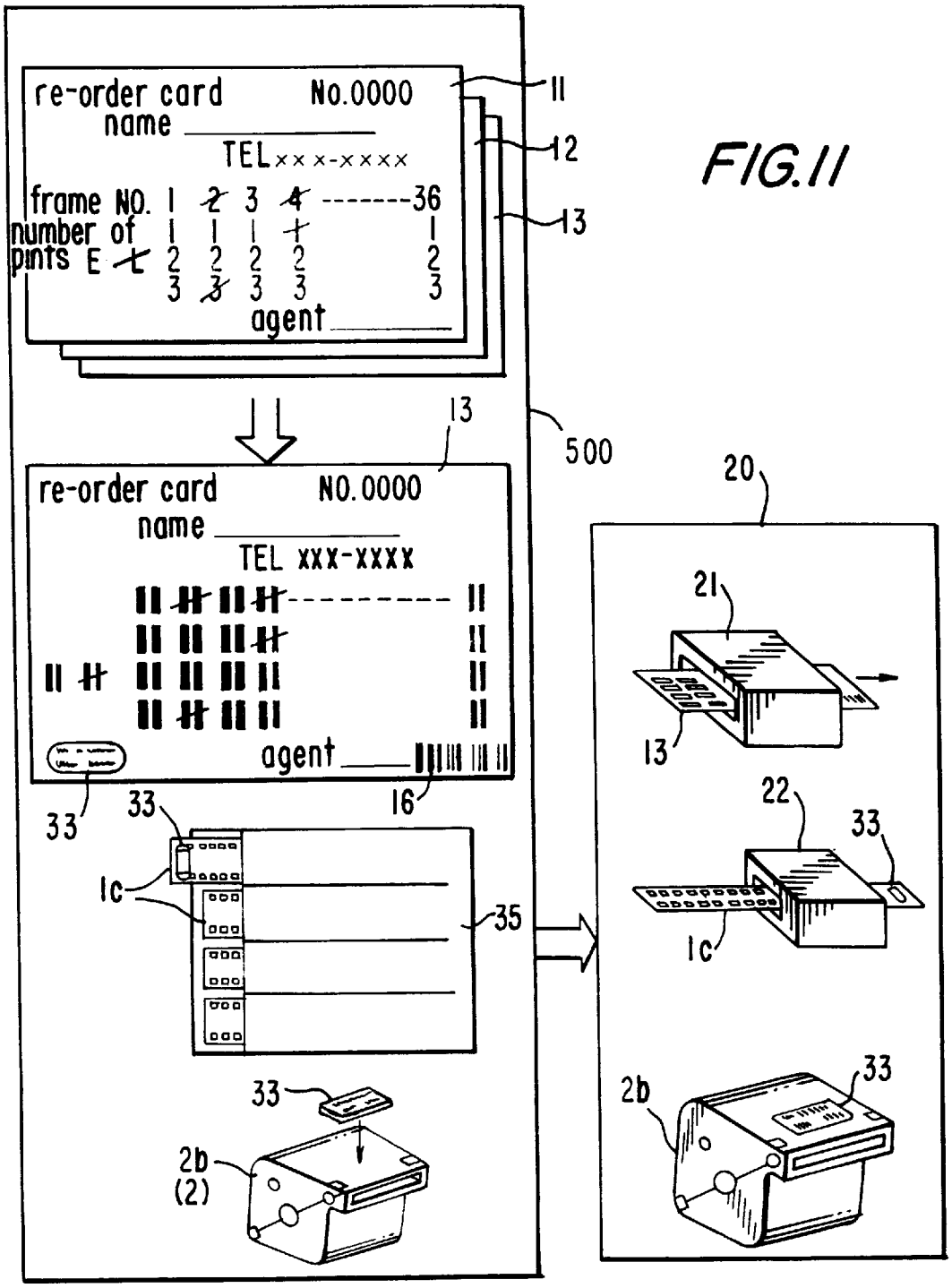
FIG. 11 is a descriptive view illustrating operations effected at a service agent in the case of a re-ordered printing.
Figure 12:
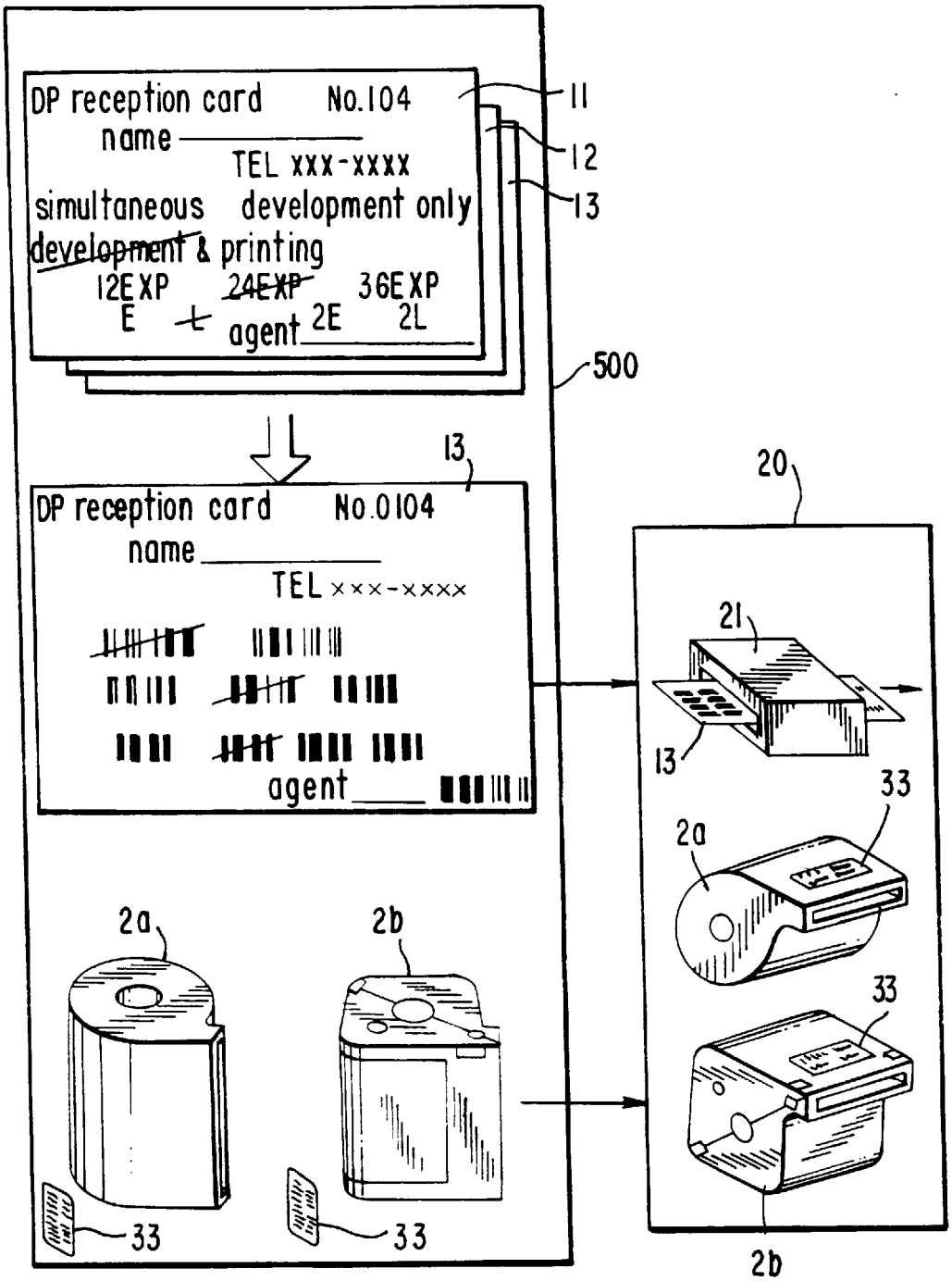
FIG. 12 is a descriptive view illustrating operations effected at the service agent in the case of a simultaneous printing.

When a consumer places an order for development and/or printing of either type of film 1 at the service agent 500 of the processing laboratory 400, the service agent 500 keeps this film 1 and issues an order alip book consisting of three pressure-sensitive sheets as illustrated in FIGS. 11 and 12. Specifically, this order slip book consists of the customer's duplicate slip 11 to be handed to the consumer, the agent's confirmation slip 12 to be kept at the agent 500 and the laboratory slip 13 to be sent to the processing laboratory 400 together with the film 1.

FIG. 11 shows an order slip book issued in the case of an order for reprinting. The book bears such photographic processing information in the form of a number of bar codes as 'frame number', 'number of prints', 'print size', 'type of printing paper' and so on which items are selected by the customer. The book further includes entries in which such customer information items as name, address and telephone number and also the name of the service agent are to be entered. Further, the laboratory slip 13 includes an agent ID bar code 16 indicating an ID code identifying the service agent 500.

FIG. 12 shows an order book issued in the case of an order for simultaneous development and printing. This order book includes such photographic processing information items in the form of a number of bar codes as 'necessity/non-necessity of simultaneous development and printing', 'film length', 'print size' and so on, which items are selected by the consumer. In the other respects, this order slip book is same is that for the reprinting order.

In the case of the reprinting order, when the order slip book is issued, a bar-code label 33 is affixed to each of the laboratory slip 13 and the film 1*b* which indicates the ID code for allowing collation between this order book and the film 1*b* kept from the consumer. More particularly, if the agent receives and keeps the film in the form of the plurality of film strips 1*c*, the bar-code label 33 is affixed to the leading one of the plurality of film strips. On the other hand, if the agent receives the film stored in the cartridge 2*b*, the label 33 is affixed to the cartridge 2*b*.

As shown in FIG. 12, in the case of an order for a simultaneous development and printing too, the bar-code label 33 is affixed, This bar-code label 33 to be affixed to the film container 2, as will be detailed later, has a double-layered sheet construction which allows repeated adhesion, for the following reason. Namely, in the photographic processing in the processing factory 400, the film 1 is withdrawn from the film container 2, and at this stage, the bar-code label needs to be re-affixed to this withdrawn film 1.

With completion of the affixing operation of the bar-code labels 33, the laboratory slip 13 and the film 1, even when separated from each other, may be collated with each other, with reference to the ID code. Therefore, when the film 1 is sent from the service agent 500 to the processing laboratory 400, the laboratory slip 13 and the film 1 may be sent separately from each other.

On the laboratory slip 13 and the film 1 sent to the processing laboratory 400, the receiving operations are effected at the receiving station 20, as described hereinbefore.

More particularly, in the case of the re-ordered print film, in the receiving operations, the photographic processing information recorded in the laboratory slip 13 in the form of a plurality of bar codes, the agent-name indicating bar code 14 and also the ID code of the bar-code labels 33 are read by a slip bar-code reader 21 and inputted to the host computer 200 in the photographic processing system installed in the processing laboratory 400. In addition, the bar-code label 33 affixed to the film strip 1*c* too is read by a film bar-code reader 22. Further, in the case of a cartridge 2*b*, its bar-code label 33 is read by a cartridge bar-code reader 23. These pieces of information inputted to the host computer 200 in the above-described manners are all stored therein in correlation with the ID code, so that the information may be uniquely correlated with the film container 2 and e.g. the film strips 1*c* by means of the ID code of the bar-code labels 33 affixed to the film container 2 and the film strip 1*c*. Accordingly, in the subsequent operations, the host computer 200 may grasp the photographic processing information of each film 1 being processed in this photographic processing system.

On the other hand, in the case of a simultaneous development and printing, in the receiving operations, the slip bar-code reader 21 is used for reading the information recorded in the laboratory slip 13 and the bar-code label 33 affixed to the film container 2. The other operations are substantially the same as those effected in the above-described case of re-ordered print film, except that the film bar-code reader 22 is not used in this case.

Figure 14A:
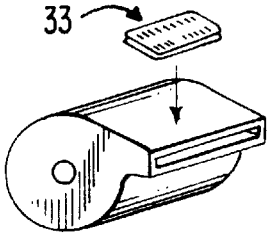
Figure 14B:
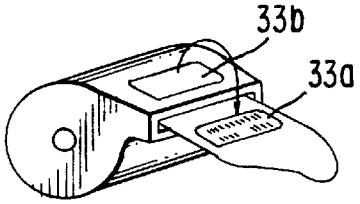
Figure 14C:
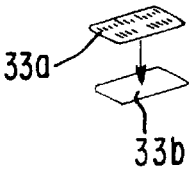

In this case of a simultaneous development and printing, the bar-code label 33 to be affixed to the film container 2 may be provided as the double-layered construction shown in FIGS. 14(*a*)–(*c*). Namely, this double-layered label 33 includes a base 33*b* having an adhesive layer on the back side thereof and a bar-code indicating portion 33*a* including on its back side an re-adhesive type adhesive layer and indicating the ID code. Then, the bar-code indicating portion 33*a* affixed together with the base portion 33*b* to the film container 2 at the service agent 500 is removed from the base portion 33*b* when the film 1*a* is withdrawn from the container 2, and then affixed to the leading end of the withdrawn film 1*a*. With this, this film 1*a* withdrawn from the film container 2 may be collated anytime with the processing information inputted to the host computer 200 via the ID code of the re-affixed bar-code indicating portion 33*a*.

Upon completion of the receiving operation of the re-ordered print film, the developed film 1*b* (i.e. the film strips 1*c*) is set to the first sorter station 40, in which this film 1*b* is sorted into a certain group according to the printing condition information such as the print size read from the laboratory slip 13. The following description is based on an assumption that the printing condition comprises two kinds of print size, i.e. the full size and the panoramic size. Needless to say, the printing condition is not limited thereto.

Figure 13:
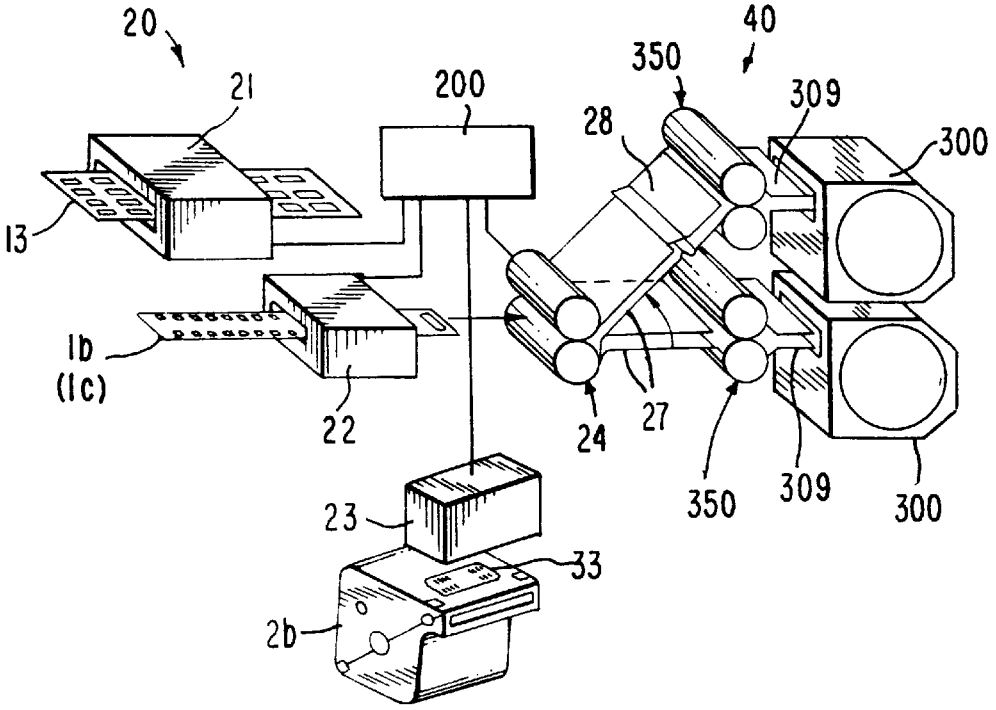
FIG. 13 is a schematic view showing a receiving station and a portion of a first sorter station, FIGS. 14(*a*) through (*c*) is a schematic view showing a double-light shielding construction of a film cartridge.

In the first sorter station 40, in the case of the full size printing condition, the film 1*b* is conveyed through the conveyer roller 24, the movable guide 27, the roller mechanism 305 and the guide plates 309 to be inserted into the film magazine 300. The construction of this film magazine 300 is identical to the magazine described in the first embodiment. On the other hand, in the case of a panoramic size printing condition, the film 1*b* is conveyed through the conveyer roller 24, the movable guide 27, the stationary guide 28, the roller mechanism 305 and the guide plates 309 to be inserted into the film magazine 300. The movable guide 27 is movable between a position denoted with a solid line and a further position denoted with an alternate long and short dashed line in FIG. 13, and the position switching of the movable guide 27 is controlled by the host computer 200. The stationary guide 28 is provided for adjusting a length of the conveying passage of the film 1*b*.

Uponcompletion of the insertion of the one order amount of film 1*b*, the film magazine 300 is set to a conveying device 60 to be described later.

Further, in the case of the re-ordered print film is provided in the form of the cartridge 2*b* too, the film 1*b* stored in this cartridge 2*b* is withdrawn therefrom and then stored in the film magazine 300 and conveyed to the conveying device 50. Alternatively, in the case of the cartridge 2*b*, rather than drawing the film therefrom and re-storing it into the magazine 300, the film as stored within the cartridge 2*b* may be directly sent to the conveying device 50.

Next, a process after completion of the receiving operation of the simultaneous print film will be described. In this case, as described hereinbefore, the bar-code label 33 is re-affixed to the film 1*a*. And, this un-developed film 1*a* is conveyed to the developing station 30, where there is effected a developing operation which per se is well-known. In this system, however, if there is any developing condition uniquely provided to the un-developed film 1*a*, the information concerning this condition is transmitted from the host computer 200 to the developing station 30.

After completion of the developing operation, the developed film 1*b* is set to the second sorter station 34, The construction of this second sorter station 34 is substantially identical to that of the first sorter station 40. Accordingly, the construction of the second sorter station 34 too will be described with reference to FIG. 13. In this second sorter station 34, the bar codes of the bar-code label 33 re-affixed to the film 1*b* are read by the film bar-code reader 22. Then, the host computer 200 searches a printing condition corresponding thereto and causes this film 1*b* to be inserted into a corresponding film magazine 300 in the same manner as the case of the re-ordered print film. Then, this film magazine 300 is charged to the conveying device 50.

Incidentally, the cartridge 2*b* is re-usable, as described hereinbefore. Thus, after its film 1*b* is withdrawn therefrom and then developed, this developed film 1*b* may be again stored into the cartridge 2*b* and then charged to the conveying device 50. However, it is also possible to insert the film 1*b* into the film magazine 300 as described above. On the other hand, in the case of the patrone 2*a*, the patrone 2*a* emptied of its film 1 is not to be re-used in general. Accordingly, the film magazine 300 is always used in the case of the patrone 2*a*.

When the film magazine 300 is used, the film container 2 and the film 1 are separated from each other. However, as described hereinbefore, the upper sheet 33*a* removed from the base sheet 33*b* of the double-layered bar-code label 33 is affixed to the leading end of this film 1 withdrawn from the container 2. With this, it is possible to collate the film 1 and its photographic processing information stored in the host computer 200.

Next, the conveying device 50 will be described in details with reference to FIG. 15.

Figure 15:
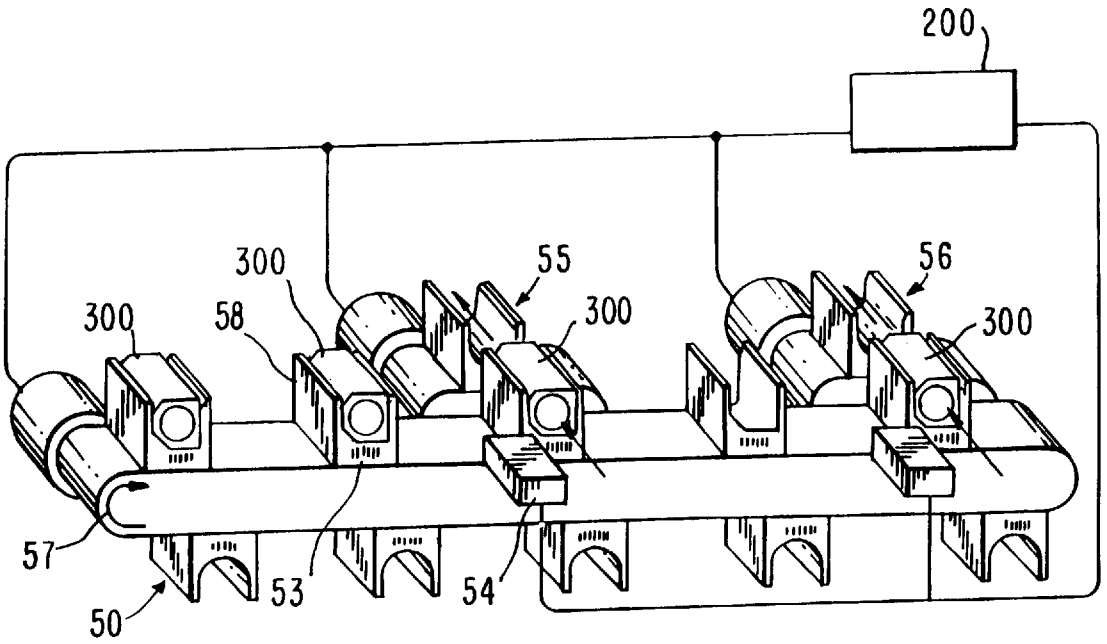
FIG. 15 is a schematic construction view of a conveying device, and FIGS. 16(*a*) and 16(*b*) is a view showing provision of an ID code to a tape or reinforcing tape to be hooked with a film leader.
Figure 16B:
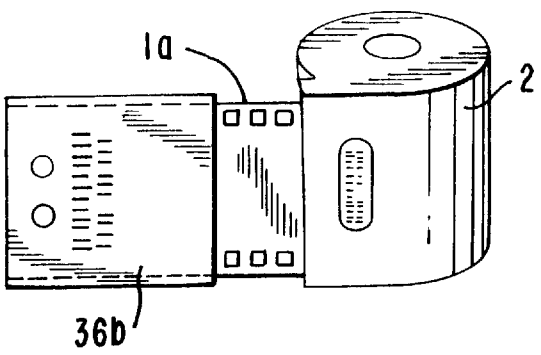
Figure 16A:
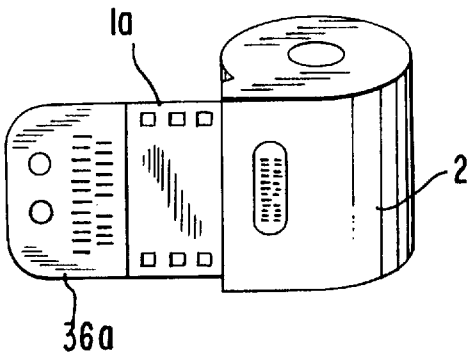

FIG. 15 illustrates a condition when the film magazines 300 sorted in the first sorter station 40 and the second sorter station 34 are being sorted to either the first stock device 55 and the second stock device 56. The first stock device 55 is used for stocking film magazines 300 to be fed to the first printing device 65 assigned for the full-size printing. The second stock device 56 is used for stocking other film magazines 300 to be fed to the second printing device 66 assigned for the panoramic-size printing. A belt conveyer 57 for conveying the film magazines 300 mounts thereon a plurality of pocket members 58 each capable of accommodating one film magazine 300. The opposed side ends and the upper end of the pocket member 58 are opened for allowing insertion of the film magazine 300 from either side or upper side. Further, on a side wall of each pocket member 58, there is attached a bar code 53 indicating an ID code for identifying each pocket member 58. As the drive of the belt conveyer 57 is controlled by the host computer 200, the host computer 200 stores information concerning whether a film magazine having a certain ID code is stored in a pocket member 58 having a certain ID code or not. The belt conveyer 57 is connected with the first stock device 55 and the second stock device 56. In operation, a bar code 53 of a pocket member 58 having reached this connecting region is read by a bar-code reader 64 and its information is inputted to the host computer 200. Then, the host computer 200 determines whether to dismount the film magazine 300 accommodated in this pocket member 58 at this connecting region or not. If the dismounting is necessary, a feeder which is illustrated only schematically by an arrow in the figure is used for moving the film magazine 300 into a similar pocket member provided to the first stock device 55.

As described above, this conveying device 50 is adapted for the film magazines 300 storing the re-ordered print films 1*b* and the further film magazines 300 storing the simultaneous print films 1*b* in a mixed state.

The film magazine 300 used herein is identical to that described in the first embodiment. The developed film 1*b* used herein may be either in the form of film strips cut into the length of e.g. six frames or an uncut one order amount of film. Accordingly, the film magazine 300 is capable of storing either one order amount of film 1*b* or a plurality of order amount of films 1*b*. The processes of inserting the film 1 into the film magazine and of discharging the former from the later are same as those described with reference to FIGS. 6 through 8.

In the printing station 60, there are provided the two printing devices, i.e. the first printing device 65 for the full-size printing and the second printing device 66 for the panoramic-size printing. However, the present invention is not limited to this particular construction. Instead, more than three printing devices may be provided, To each printing device 65, 66, film magazines 300 storing the films 1*b* suited to its particular printing condition is fed. From the fed film magazine 300, the film 1*b* is withdrawn again and its ID code is read and the photographic processing information such as the number of prints is retrieved from the host computer 200. Then, it is possible to provide the printing device 65, 66 with an instruction concerning the number of prints.

Each of these printing devices 66, 66 is capable of receiving and processing the re-ordered print films 1*b* and the simultaneous print films 1*b* in a mixed state as long as their printing conditions match each other. And, in such a mixed state too, as the necessary printing information of the film 1*b* is obtained from its ID code and managed by the host computer 200, no inconvenience occurs.

In the above description, the full-size print and the panoramic-size printing conditions are cited as examples of the printing conditions. Other examples of printing conditions are the type of printing paper quality (glossy paper, silky paper and so on) and the width of the printing paper. Further, as the print size, there are, such sizes commonly referred to as 'E', 'L', '2E', '2L' and so on. Needless to say, these plural kinds of printing conditions may be used in a variety of combinations.

After completion of the printing operation, the film 1 and its prints are set to an automatic packing station 70. As the film magazine 300 becomes unnecessary after completion of the printing operation, the film magazine 300 is returned to the sorter station 34, 40 for re-use. Then, the re-ordered print film 1 is stored in the film sheet holder 35 again and conveyed together with its prints, by the conveying device 71, to the shipping station 72. The construction of this conveying device 71 may be generally identical to that of the conveying device 50 shown in FIG. 15. On the other hand, after completion of the printing operation, the simultaneous print film 1 is cut into a plurality of film strips of a predetermined length having six frames for instance. Then, these strips are stored in the film sheet holder 35 and then conveyed together with its prints, by the conveying device 71, to the shipping station 72. Further, in the case of the cartridge 2*b*, the film 1 is stored again into the cartridge 2*b*.

At the shipping station 72, the prints and the films 1*b* are placed into the wrapping envelopes and sorted out for each service agent 500. After this sorting, the prints and the film 1*b* are shipped to the service agent 500. Incidentally, the above-described inserting operation of the film strips 1*c* into the film sheet holder 35 and the insertion operation of the film sheet holder 35 into the envelope may be effected either after or before the prints and the film 1*b* are mounted on the conveying device 71.

Next, some other modified embodiments of the present invention will be specifically described.

(1) In the foregoing embodiments, the affixing operation of the bar-code labels 33 is effected at the service agent 500. Instead, this operation may be effected at the receiving station 20 in the processing laboratory 400.

(2) In the foregoing embodiments, the bar-code readers 21 are provided separately for reading the printing information of the simultaneous print film and the re-ordered print film, respectively. Instead, one bar-code reader 21 may be commonly used for reading the information of the both types of films.

(3) In the foregoing embodiments, when the bar-code label 33 is affixed to the film strip 1*c*, the label 33 is affixed only to the leading strip 1*c*. Instead, a plurality of labels 33 may be affixed to all of the film strips for one order amount.

(4) In the foregoing embodiments, the order book is employed as the recording medium for recording the customer's information or the re-order information. Instead, the information may be recorded in the envelope. Or, any other compact recording medium such as an IC card, a floppy disc or the like may be employed.

(5) In the foregoing embodiments, the bar code 53 is employed as the distinguishing means for distinguishing the position of the film on the conveying passage of the conveying device 50. The distinguishing means is not limited thereto. For instance, it is also conceivable to adapt the video camera to recognize a position coordinate of the film.

(6) In the foregoing embodiments, the bar-code label 33 is not affixed to the film magazine 300. This is because the bar-code label 33 is affixed already to the film 1 stored within the magazine 300. Needless to say, it is also conceivable to affix the label 33 also to the film magazine 300. In this case, this affixing operation will be effected at the sorter stations 34, 40.

(7) In the photographic processing, a tape 36*a* or reinforcing tape 36*b* to be connected with the leader may be attached to the film 1*a*. In such case, the ID code may be copied in this tape 36. With this, the film 1*a* withdrawn from the film container 2 too may always be correlated, via this copied ID code, with its processing information stored in the host computer 200.

(8) In the foregoing embodiments, the bar codes are employed as the ID code. Instead, marks or characters may be employed singly or in combination. In case the ID code is constituted solely from such marks or characters, it is necessary to use e.g. an optical character reader (OCR), instead of the bar code reader. However, when the bar codes and marks or characters are used in combination, as the bar codes are provided solely for input to the computer while the marks or characters are provided solely for recognition by human, the OCR or the like will not be needed and only the bar code reader will be provided in the system.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A photographic processing system comprising:

means for reading processing information of a photographic film;

a sorter station for sorting the film in accordance with the processing information read from the film;

a photographic processing apparatus comprising a photographic printing device for effecting a photographic processing operation in accordance with the processing information wherein said processing information includes information concerning a print size; and a conveying device for conveying the film sorted at the sorter station to the photographic processing apparatus, wherein for a film having the processing information concerning development alone, said photographic printing device produces at least one blank print.

2. A photographic processing system as defined in claim 1, wherein said photographic processing apparatus comprises a film developing device and said processing information includes information concerning a film length.

3. A photographic processing system as defined in claim 2, wherein there are provided a plurality of said film developing devices which are set to different processing conditions to suit different processing information.

4. A photographic processing system as defined in claim 3, wherein said sorter station functions so that each of said developing devices is continuously fed with a predetermined number of films having a common film length.

5. A photographic processing system as defined in claim 1, wherein said photographic processing apparatus comprises a photographic printing device and said processing information includes printing paper data relating to a printing paper width and a printing paper quality.

6. A photographic processing system as defined in claim 1, wherein there are provided a plurality of said photographic printing devices which are set to different processing conditions to suit different processing information.

7. A photographic processing system as defined in claim 1, wherein said sorter station functions so that each of said photographic printing device is continuously fed with a predetermined number of films having common printing information.

8. A photographic processing system as defined in claim 1, wherein a film having the processing information concerning only development is caused to bypass a conveying/printing line of said photographic printing device.

9. A photographic processing system as defined in claim 1, wherein said photographic processing apparatus includes;

a stock station for stocking the film; and a monitor device for monitoring the amount of the film stocked at said stock station.

10. A photographic processing system comprising:

means for reading processing information of a photographic film;

a sorter station for sorting the film in accordance with the processing information read from the film;

a plurality of developing devices and photographic printing devices capable of effecting photographic processing operations in accordance with the processing information;

a conveying device for conveying the film sorted at the sorter station to the developing devices and photographic printing devices; and a host computer connected with said components of the system;

wherein said processing information includes development data, printing date, and said host computer is capable of storing an ID code comprising information concerning a service agent and the processing information of the film in correlation with each other wherein said printing data comprises print size data.

11. A photographic processing system as defined in claim 10, further comprising a film magazine for taking up and storing a plurality of films conveyed from said film developing device, said film magazine being used to convey the films to the photographic printing device.

12. A photographic processing system as defined in claim 11, wherein said photographic films are divided into groups according to the processing information thereof, the films of a group being commonly stored in a film magazine.

13. A photographic processing system as defined in claim 11, wherein said film magazine is replaced by a another film magazine, such that a film magazine emptied of the films is returned to an original processing position thereof in said developing device or said printing device.

14. A photographic processing system as defined in claim 10, wherein said conveying device includes a plurality of film holding portions each holding the photographic film, and distinguishing means for distinguishing the film holding portions from each other.

15. A photographic processing system comprising:

first reading means for reading printing information comprising print size information of a re-ordered print film;

a first sorter station for sorting the re-ordered print film according to the printing information;

a plurality of photographic printing devices each capable of printing the re-ordered print film according to the printing information; and a conveying device for conveying the re-ordered film sorted at the first sorter station to one of the printing devices.

16. A photographic processing system as defined in claims 15, further comprising:

second reading means for reading printing information of a simultaneous-print film;

a second sorter station for sorting the simultaneous-print film according to the printing information;

the conveying device being capable of conveying the re-ordered print film sorted at the first sorter station and the simultaneous print film sorted at the second sorter station together in a mixed state along a common conveying passage to at least one of said photographic printing devices; and means for distinguishing a position of each film on the conveying passage.

17. A photographic processing system as defined in claim 15, further comprising a host computer capable of causing a re-ordered print film and a simultaneous-print film having common printing information to a same one of the printing devices.

18. A photographic processing system as defined in claim 15, wherein the plurality of said photographic printing devices are set to different printing conditions according to different printing information.

19. A photographic processing system as defined in claim 15, wherein said first reading means reads the printing information from a recording medium which records at least either consumer information or re-order information.

20. A photographic processing system as defined in claim 15, further comprising a film magazine capable of taking up and storing at least one order amount of re-ordered print film therein, the film magazine being used for conveying the re-ordered print film to said photographic printing device.

21. A photographic processing system as defined in claim 15, further comprising a film magazine capable of taking up and storing at least one order amount of film therein, the film magazine being used for conveying the re-ordered print film and the simultaneous-print film to said photographic printing device.

22. A photographic processing system as defined in claim 15, further comprising a film magazine capable of taking up and storing films having common printing information, the film magazine being used for conveying the films having common printing information to said photographic printing device.

23. A method of collating an order for use with a photographic processing system, which comprises the steps of:

issuing an order slip having an ID code recording consumer information, information concerning a service agent and re-order information with reception of a re-order of photographic processing of a photographic film;

providing the ID code to the photographic film or a container thereof; and reading the information of the order slip by the photographic processing system before the photographic processing.

24. A method as defined in claim 23, wherein a label recording the ID code is affixed to the photographic film or container thereof.

25. A method as defined in claim 23, wherein in the photographic processing by the photographic processing system, the ID code is recorded in a tape or reinforcing tape to be hooked with a leader which is connected with the photographic film.

26. A method as defined in claim 23, wherein a label recording the ID code comprises a double-layered construction including a base label sheet having an adhesive layer on a back face thereof and an upper label sheet having a re-adhesive layer on a back face thereof and recording the ID code, the upper label sheet affixed to the film container together with the base label sheet may be affixed to a leading end of the film drawn out of the container when necessary.

27. A method as defined in claim 23, wherein the ID code comprises one selected from a bar code, marks, characters or combinations thereof.

28. A photographic processing system comprising:

a receiving station for receiving a photographic film and providing the film with an ID code;

means for reading processing information of the film, the processing information including film developing data and photographic printing date;

a plurality of film developing devices and a plurality of photographic printing devices, each capable of a photographic processing operation in accordance with the processing information;

a first sorter station for sorting the film into a most suitable one of said film developing devices in accordance with said processing information read from the film;

a second sorter station for sorting the developed film into a most suitable one of said photographic printing devices in accordance with the processing information read from the film;

a conveying device for conveying the film sorted at said first sorter station to said most suitable one of said film developing devices and for conveying the film sorted at said second sorter station to said most suitable one of said photographic printing devices; and a host computer connected to said components of the system, wherein said host computer is capable of storing an ID code and the processing information in correlation with each other.

29. The photographic processing system of claim 28, wherein said conveying device conveys the film through one of said photographic printing devices even when said photographic printing data read from the film indicates that printing is unnecessary.

30. The photographic processing system of claim 29, wherein when the film having the data indicating that printing is unnecessary goes through said one of said photographic printing devices, the device produces at least one non-photographic print which is identifiable from a normal print.

31. The photographic processing system of claim 30, wherein said non-photographic print comprises a blank print.

32. The photographic processing system of claim 28, wherein said first sorter station sorts the received film in accordance with a film length, and feeds each said conveying device with a plurality of films having a common film length.

* * * * *